US008130061B2

(12) United States Patent
Fukunaga

(10) Patent No.: US 8,130,061 B2
(45) Date of Patent: Mar. 6, 2012

(54) FILTER

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 689 days.

(21) Appl. No.: 12/232,800

(22) Filed: Sep. 24, 2008

(65) Prior Publication Data

US 2009/0085693 A1 Apr. 2, 2009

(30) Foreign Application Priority Data

Sep. 28, 2007 (JP) ..... 2007-254467

(51) Int. Cl.
*H01P 1/203* (2006.01)
*H01P 7/08* (2006.01)

(52) U.S. Cl. ..... 333/204; 333/219

(58) Field of Classification Search ..... 333/165–168, 333/175, 176, 185, 202–205, 219, 235
See application file for complete search history.

(56) References Cited

U.S. PATENT DOCUMENTS 4,642,591 A 2/1987 Kobayashi
7,525,401 B2 * 4/2009 Abe et al. ..... 333/204
2007/0024398 A1 * 2/2007 Fukunaga ..... 333/203

FOREIGN PATENT DOCUMENTS

| | | |
|---|---|---|
| JP | A-61-121502 | 6/1986 |
| JP | A-5-335805 | 12/1993 |
| JP | A-6-204703 | 7/1994 |
| JP | B2-3067612 | 7/2000 |
| JP | A-2007-180684 | 7/2007 |

* cited by examiner

*Primary Examiner* — Benny Lee
*Assistant Examiner* — Gerald Stevens
(74) *Attorney, Agent, or Firm* — Oliff & Berridge, PLC

(57) ABSTRACT

A filter being small and having a narrowband filter characteristic is achieved using interdigital-coupled resonators. A first resonator and a second resonator are configured using interdigital-coupled quarter-wavelength resonators respectively. In addition, the first resonator and the second resonator are disposed so as to extend along directions intersecting with each other at a predetermined angle θ. Thus, coupling between the resonators is reduced compared with, for example, a case that the first resonator and the second resonator are, as a whole, disposed in parallel to each other. The angle θ, with which the first resonator and the second resonator are disposed respectively, is adjusted, thereby coupling between the resonators may be made into a desired state. Thus, a desired narrowband filter characteristic is obtained.

7 Claims, 23 Drawing Sheets

| ANGLE: θ (degree) | DISTANCE: D (mm) | f2 (GHz) | f1 (GHz) | COUPLING COEFFICIENT :k |
|---|---|---|---|---|
| 0 | 0.2 | 2.060754340 | 3.378776945 | 0.457734628 |
| 30 | 0.2 | 2.071109653 | 3.225668148 | 0.416174001 |
| 45 | 0.2 | 2.107181812 | 3.045956424 | 0.352647045 |
| 50 | 0.2 | 2.174558594 | 3.032125452 | 0.320709854 |
| 55 | 0.2 | 2.200093989 | 2.935042620 | 0.280497423 |
| 60 | 0.2 | 2.213246168 | 2.799119161 | 0.230620279 |
| 0 | 0.3 | 2.129602660 | 3.120957548 | 0.364620369 |
| 30 | 0.3 | 2.131189727 | 3.027729180 | 0.337379531 |
| 45 | 0.3 | 2.155367311 | 2.918942468 | 0.294293325 |
| 50 | 0.3 | 2.209861882 | 2.920593152 | 0.271846613 |
| 55 | 0.3 | 2.226149075 | 2.852642298 | 0.243011806 |
| 60 | 0.3 | 2.229489718 | 2.747361250 | 0.205882901 |
| 0 | 0.4 | 2.193582983 | 2.966601049 | 0.293032672 |
| 30 | 0.4 | 2.185807456 | 2.897199540 | 0.274532560 |
| 45 | 0.4 | 2.196725289 | 2.817040195 | 0.243714137 |
| 50 | 0.4 | 2.251899556 | 2.837827670 | 0.227228142 |
| 55 | 0.4 | 2.260470200 | 2.786275267 | 0.206136326 |
| 60 | 0.4 | 2.257262996 | 2.702368429 | 0.178057212 |

FIG. 13

| ANGLE: θ (degree) | DISTANCE: D (mm) | f2 (GHz) | f1 (GHz) | COUPLING COEFFICIENT :k |
|---|---|---|---|---|
| 30 | 0.2 | 2.056080103 | 3.323755976 | 0.446479158 |
| 45 | 0.2 | 2.065967743 | 3.237595314 | 0.421267594 |
| 50 | 0.2 | 2.098873469 | 3.231904796 | 0.406716780 |
| 55 | 0.2 | 2.108918386 | 3.177445053 | 0.388389660 |
| 60 | 0.2 | 2.117028910 | 3.096858806 | 0.363032795 |
| 30 | 0.3 | 2.124978301 | 3.084081155 | 0.356169670 |
| 45 | 0.3 | 2.127295784 | 3.024272605 | 0.337987751 |
| 50 | 0.3 | 2.157532838 | 3.029404788 | 0.326942346 |
| 55 | 0.3 | 2.167807447 | 2.996951213 | 0.313010333 |
| 60 | 0.3 | 2.171656940 | 2.940311421 | 0.294078509 |
| 30 | 0.4 | 2.183711040 | 2.932710722 | 0.286639809 |
| 45 | 0.4 | 2.190968743 | 2.899448210 | 0.273068568 |
| 50 | 0.4 | 2.216803180 | 2.906751906 | 0.264527308 |
| 55 | 0.4 | 2.223046817 | 2.881199516 | 0.253666891 |
| 60 | 0.4 | 2.218148038 | 2.832178999 | 0.239622661 |

FIG. 16

FILTER

CROSS REFERENCES TO RELATED APPLICATIONS

The present invention contains subject matter related to Japanese Patent Application JP 2007-254467 filed in the Japanese Patent Office on Sep. 28, 2007, the entire contents of which being incorporated herein by reference.

BACKGROUND OF THE INVENTION

1. Field of the Invention

The present invention relates to a small filter suitable for radio communication equipments such as cellular phones.

2. Background Art

Size reduction is required for a filter used for radio communication equipments such as cellular phones. Therefore, size reduction is required even for resonators configuring the filter. A filter has been developed in the past, in which each resonator is configured using a TEM (Transverse Electro Magnetic) line to achieve size reduction. Here, as a method of coupling two resonators including the TEM line respectively to each other, two types of coupling can be typically listed: comb-line coupling and interdigital coupling. Japanese Patent No. 3067612 and Japanese Unexamined Patent Publication No. 2007-180684 disclose inventions in which a small band-pass filter is configured using interdigital-coupled resonators, respectively.

SUMMARY OF THE INVENTION

FIG. 18 shows a configuration where a pair of resonators 111 and 112 are comb-line-coupled to each other. FIG. 19 shows a configuration where the pair of resonators 111 and 112 are interdigital-coupled to each other. Each of the pair of resonators 111 and 112 is formed such that one end is an open end, and the other end is a short-circuit end. As shown in FIG. 18, the comb-line coupling is a coupling method providing a structure where resonators are disposed such that their respective short-circuit ends are opposed to each other, and their respective open ends are opposed to each other. As shown in FIG. 19, the interdigital coupling is a coupling method providing a structure where an open end of one resonator 111 is opposed to a short-circuit end of the other resonator 112, and a short-circuit end of one resonator 111 is opposed to an open end of the other resonator 112. It is known that when a coupling coefficient due to an electric field is assumed to be ke, and a coupling coefficient due to a magnetic field is assumed to be km, a coupling coefficient k due to the comb-line coupling is k=ke−km, and a coupling coefficient k due to the interdigital coupling is k=ke+km. Moreover, the interdigital coupling is known as coupling in which electric field coupling and magnetic field coupling do not cancel each other unlike the comb-line coupling, so that extremely strong coupling is obtained compared with the comb-line coupling.

FIG. 20 shows a basic configuration of a filter configured using interdigital-coupled resonator pairs. The filter has a first resonator 101 having a pair of interdigital-coupled resonators 111 and 112, a second resonator 102 having a different pair of interdigital-coupled resonators 121 and 122, an input terminal 104 connected to the first resonator 101, and an output terminal 105 connected to the second resonator 102.

As a method of specifically configuring the filter of FIG. 20, formation of a stacked dielectric filter as shown in FIG. 21 is considered. The dielectric filter has a dielectric block 100 having a rectangular solid shape including a dielectric material, where the dielectric block is formed to be in a multilayer structure. A line pattern of a conductor (strip line) is formed within the dielectric block, and the pair of resonators 111 and 112, the different pair of resonators 121 and 122, the input terminal 104, and the output terminal 105 are formed as inner layers by the inside line pattern. Two side faces opposed to each other of the dielectric block 100 are formed to be ground electrodes. Short-circuit ends of the pair of resonators 111 and 112 and short-circuit ends of the different pair of resonators 121 and 122 are connected to the ground electrodes of the side faces respectively. External terminal electrodes 106 and 107 are formed on other two side faces opposed to each other of the dielectric block 100, and the input terminal 104 and the output terminal 105 are connected to the external terminal electrodes respectively.

In the configuration example, the filter is in a structure where the first resonator 101 and the second resonator 102 are, as a whole, disposed in parallel to each other. A structure of the filter described in each of above-described Japanese Patent No. 3067612 and Japanese Unexamined Patent Publication No. 2007-180684 is the same in essential portions as the structure of the configuration example. As a feature of such a structure, coupling between the first resonator 101 and the second resonator 102 may be intensified. In the case of such a structure, electric fields largely couple to each other between opposed resonators in the pair of resonators 111 and 112 and in the different pair of resonators 121 and 122 respectively. Therefore, coupling by an electric field is hardly found between the adjacent first and second resonators 101 and 102, and coupling by a magnetic field is found. That is, as the coupling coefficient, ke≅0 and k≅km are given between the first and second resonators 101 and 102.

Strong coupling between the first and second resonators 101 and 102 is suitable for configuring a broadband bandpass filter. On the other hand, the coupling needs to be reduced in order to configure a narrowband filter. However, to reduce the coupling in the structure as shown in FIG. 21, the first resonator 101 needs to be physically spaced away from the second resonator 102, or a different electrode needs to be inserted between the resonators, which is contrary to size reduction and therefore not preferable.

The described Japanese Unexamined Patent Publication No. 2007-180684 describes that a filter being relatively reduced in size may be configured using a pair of interdigital-coupled resonators. This is described below. Hereinafter, description is made assuming that the pair of resonators 111 and 112, and the different pair of resonators 121 and 122 include a pair of quarter-wavelength resonators respectively.

First, a resonance mode of a pair of interdigital-coupled quarter-wavelength resonators is described. Consideration is first made with reference to FIGS. 24 and 25 on a resonance mode in the case that two resonators resonating at the same frequency are coupled to each other. When the resonators are spaced away from each other, since the resonators are not coupled to each other at all, resonance peaks are superposed on each other at the same frequency. However, when the resonators are made closer to each other, since jump of a radio wave may occur, each resonator does not independently resonate, and a hybrid resonance mode including resonance modes of the two resonators being mixed is formed, and consequently a resonance peak is split in two. Here, the two resonance modes in the hybrid resonance mode are assumed to include a first resonance mode (mode 1) and a second resonance mode (mode 2). When the resonators are weakly coupled to each other, since a split level is low, feet of resonance peaks in the two resonance modes overlap with each other as shown in FIG. 24. In this case, a resonance frequency $f_2$ of the second resonance mode being a low resonance mode slightly contain a component of the first resonance mode since the resonance frequency $f_2$ is overlapped with the resonance peak of the first resonance mode. However, when the resonators are strongly coupled, since the resonance peaks are spaced away from each other, a state containing no component of the first resonance mode may be made at a resonance frequency $f_2$ at which resonance occurs in the second resonance mode, as shown in FIG. 25. In other words, coupling between the resonators is intensified, thereby purity of a resonance mode may be improved.

In the pair of interdigital-coupled quarter-wavelength resonators 111 and 112, a resonance state may be divided into two intrinsic resonance modes. The same is true for the different pair of quarter-wavelength resonators 121 and 122. FIG. 22 shows the first resonance mode of the pair of interdigital-coupled quarter-wavelength resonators 111 and 112, and FIG. 23 shows the second resonance mode of the resonators. In FIGS. 22 and 23, each curve shown by a broken line shows distribution of an electric field E in each resonator. FIGS. 22 and 23 show a resonance state of the pair of quarter-wavelength resonators 111 and 112 respectively, where the other end of each resonator is in a ground state, meaning that the other end is at zero potential in alternating current.

In the first resonance mode, a current i flows from an open end side to a short-circuit end side in each of the pair of quarter-wavelength resonators 111 and 112, and the current i flows through the respective resonators in opposite directions to each other. In the first resonance mode, an electromagnetic wave is driven in phase between the pair of quarter-wavelength resonators 111 and 112. In the first resonance mode, each of a phase and amplitude of the electric field E has the same value at rotationally symmetrical positions with respect to a physical rotation symmetry axis of the pair of quarter-wavelength resonators 111 and 112 as a whole. That is, the first resonance mode corresponds to a common mode. When a pair of balanced terminals 104A and 104B are connected to the rotationally symmetrical positions respectively, common mode signals are outputted from the pair of balanced terminals 104A and 104B in the first resonance mode.

On the other hand, in the second resonance mode, the current i flows from an open end side to a short-circuit end side in one quarter-wavelength resonator 111, and the current i flows from the short-circuit end side to the open end side in the other quarter-wavelength resonator 112, and consequently the current i flows through the respective resonators in the same direction. That is, in the second resonance mode, as known from distribution of an electric field E, an electromagnetic wave is driven in phase opposition between the pair of quarter-wavelength resonators 111 and 112. In the second resonance mode, phases of the electric field E are different by 180°, and absolute values of amplitude thereof are the same at rotationally symmetrical positions with respect to a physical rotation symmetry axis of the pair of quarter-wavelength resonators 111 and 112 as a whole. That is, the second resonance mode corresponds to a differential mode. When the pair of balanced terminals 104A and 104B are connected to the rotationally symmetrical positions respectively, balanced signals being excellent in both of amplitude balance and phase balance may be extracted from the pair of balanced terminals 104A and 104B in the second resonance mode.

FIG. 26 shows a distribution condition of a resonance frequency of each of the pair of interdigital-coupled quarter-wavelength resonators 111 and 112. As a feature of the interdigital coupling, an intermediate resonance frequency $f_0$ between the first resonance frequency $f_1$ and the second resonance frequency $f_2$ corresponds to a frequency in the case that a resonator resonates at a quarter wavelength determined by physical length of a line (i.e., resonance frequency of an individual quarter-wavelength resonator when resonators are not interdigital-coupled to each other). Therefore, the second resonance frequency $f_2$ having a relatively low frequency is set as a passing frequency, thereby a resonator as a whole may be reduced in size compared with a case that the passing frequency is set to be the resonance frequency $f_0$. For example, when a filter using 2.4 GHz band as the passing frequency is designed, a quarter-wavelength resonator may be used, the resonator having a physical length being set in correspondence to, for example, 8 GHz. Such a filter is small compared with a case of using a quarter-wavelength resonator having a physical length being set in correspondence to the 2.4 GHz band. Furthermore, in the second resonance mode, an advantage is given, that is, when coupling is intensified, the intensified coupling brings the same magnetic field distribution as in the case that the pair of quarter-wavelength resonators 111 and 112 are virtually regarded as one conductor, so that conductor thickness is virtually increased, consequently conductor loss may be decreased.

In this way, when the passing frequency of a filter is set to be the second resonance frequency $f_2$ in the second resonance mode, a bandpass filter being small and having a low conduction loss may be achieved. Moreover, since strong coupling is obtained through interdigital coupling, a broadband bandpass filter may be achieved. FIG. 28 shows an attenuation characteristic and a loss characteristic of a filter configured by using such features of the interdigital coupling. Specifically, FIG. 28 shows characteristics of a filter having a configuration shown in FIG. 27. In the filter shown in FIG. 27, a third resonator 103 is disposed in parallel between the first and second resonators 101 and 102, in addition to the configuration of the filter shown in FIG. 21. The third resonator 103 is configured by a pair of interdigital-coupled quarter-wavelength resonators 131 and 132 as in the first resonator 101 and the second resonator 102. In FIG. 28, a horizontal axis shows frequency, and a vertical axis shows attenuation. In FIG. 28, a curve with a sign S21 shows a passing loss characteristic of a signal in the filter. A curve with a sign S11 shows a reflection loss characteristic seen from an input terminal side. As known from FIG. 28, an excellent attenuation characteristic and an excellent loss characteristic are obtained over a wide band.

However, when such features of the interdigital coupling are used to achieve size reduction, resonators become closer to each other, and consequently coupling is intensified (a coupling coefficient is increased). Such a feature is suitable for configuring a small, broadband filter. However, since coupling is too strong, a small, narrowband filter is hardly configured. Coupling needs to be reduced in order to configure a narrowband filter. Thus, to satisfy various requests from consumers, a configuration suitable for a narrowband filter is still conveniently achieved by reducing coupling between resonators while making use of the advantages of small size given by the interdigital coupling.

In view of foregoing, it is desirable to provide a filter being small and capable of exhibiting a narrowband filter characteristic by using interdigital-coupled resonators.

A filter according to an embodiment of the invention has a first resonator having a plurality of quarter-wavelength resonators facing each other, each couple of neighboring quarter-wavelength resonators of the plurality of quarter-wavelength resonators are interdigital-coupled to each other, and a second resonator having a plurality of different quarter-wavelength resonators facing each other, each couple of neighboring quarter-wavelength resonators of the plurality of different quarter-wavelength resonators are interdigital-coupled to each other, where the first resonator and the second resonator are, as a whole, disposed so as to extend along directions intersecting with each other at a predetermined angle, and electromagnetically coupled to each other.

In the filter according to an embodiment of the invention, the first resonator and the second resonator are configured using the interdigital-coupled quarter-wavelength resonators respectively, thereby small size is easily achieved. Moreover, the first resonator and the second resonator are disposed so as to generally intersect with each other at a predetermined angle, thereby coupling between the resonators is reduced compared with, for example, a case that the first resonator and the second resonator are as a whole, disposed in parallel to each other. Moreover, the angle, with which the first resonator and the second resonator are disposed respectively, is adjusted, thereby coupling between the resonators may be made into a desired state. Thus, a desired narrowband filter characteristic is obtained.

In the filter according to an embodiment of the invention, short-circuit end of the quarter-wavelength resonator configuring the first resonator and a short-circuit end of the different quarter-wavelength resonator configuring the second resonator may be connected to a couple of separate ground electrodes angled to each other, respectively.

For example, in the case that the first resonator and the second resonator are formed within a dielectric block having a rectangular solid shape, and ground electrodes are formed on first and second surfaces facing each other of the dielectric block, and on third and fourth surfaces facing each other of the dielectric block, the third and fourth surfaces being perpendicular to the first and second surfaces, the short-circuit ends of the quarter-wavelength resonators configuring the first resonator may be connected to ground electrodes formed on the first and second surfaces of the dielectric block, respectively and the short-circuit ends of the different quarter-wavelength resonators configuring the second resonator may be connected to different ground electrodes formed on the third and fourth surfaces of the dielectric block, respectively.

Alternatively, in the filter according to an embodiment of the invention, a short-circuit end of the quarter-wavelength resonator configuring the first resonator and a short-circuit end of the different quarter-wavelength resonator configuring the second resonator may be connected to a common ground electrode, or a couple of separate ground electrodes parallel to each other.

In this case, an auxiliary electrode provided on the short-circuit end of the quarter-wavelength resonator so as to extend along a direction intersecting with the extending direction of the quarter-wavelength resonator, and a different auxiliary electrode provided on the short-circuit end of the different quarter-wavelength resonator so as to extend along a direction intersecting with the extending direction of the different quarter-wavelength resonator may be further provided. In addition, the auxiliary electrode and the different auxiliary electrode extend so as to intersect with each other, and the short-circuit end of the quarter-wavelength resonator and the short-circuit end of the different quarter-wavelength resonator may be connected, via the auxiliary electrodes and the different auxiliary electrodes, respectively, to a common ground electrode or a couple of separate ground electrodes parallel to each other.

When the short-circuit ends of the first resonator and the short-circuit ends of the second resonator are connected to the same corresponding ground electrodes, or separate ground electrodes parallel to each other, since the first resonator is electromagnetically coupled to the second resonator in a region near each of the ground electrodes, coupling between the resonators is intensified compared with a case that the respective short-circuit ends are connected to separate ground electrodes angled to each other. The short-circuit ends of the first resonator and the short-circuit ends of the second resonator are connected to the ground electrodes via the separate auxiliary electrodes having different angles from each other, which reduces coupling via the ground electrodes.

Moreover, the filter according to an embodiment of the invention may further include a third resonator having a plurality of still different quarter-wavelength resonators facing each other, each couple of neighboring quarter-wavelength resonators of the plurality of still different quarter-wavelength resonators are interdigital-coupled to each other, where the third resonator and the second resonator are disposed so as to extend along directions intersecting with each other at a predetermined angle, and electromagnetically coupled to each other.

In this case, the second resonator may be disposed between the first resonator and the third resonator, a capacitive coupling electrode may be disposed between the first resonator and the second resonator, and another capacitive coupling electrode may be disposed between the second resonator and the third resonator.

According to the filter of an embodiment of the invention, since the first resonator and the second resonator are disposed so as to generally intersect with each other at a predetermined angle, coupling between the resonators may be reduced compared with the case that the first resonator and the second resonator are, as a whole, disposed in parallel to each other. Thus, an angle, with which the first resonator and the second resonator are disposed respectively, is adjusted, thereby a desired narrowband filter characteristic may be obtained. Moreover, since the first resonator and the second resonator are configured using the interdigital-coupled quarter-wavelength resonators respectively, small size is easily achieved.

Other and further objects, features and advantages of the invention will appear more fully from the following description.

BRIEF DESCRIPTION OF THE DRAWINGS

FIG. 13 shows a diagram showing change in coupling coefficient depending on an angle θ in the filter according to the fourth embodiment of the invention;

FIG. 16 shows a diagram showing change in coupling coefficient depending on an angle θ in the filter according to the fifth embodiment of the invention;

DETAILED DESCRIPTION OF THE PREFERRED EMBODIMENTS

Hereinafter, preferred embodiments of the invention will be described in detail with reference to accompanying drawings.

[First Embodiment]

First, a filter according to a first embodiment of the invention is described.

Figure 1:
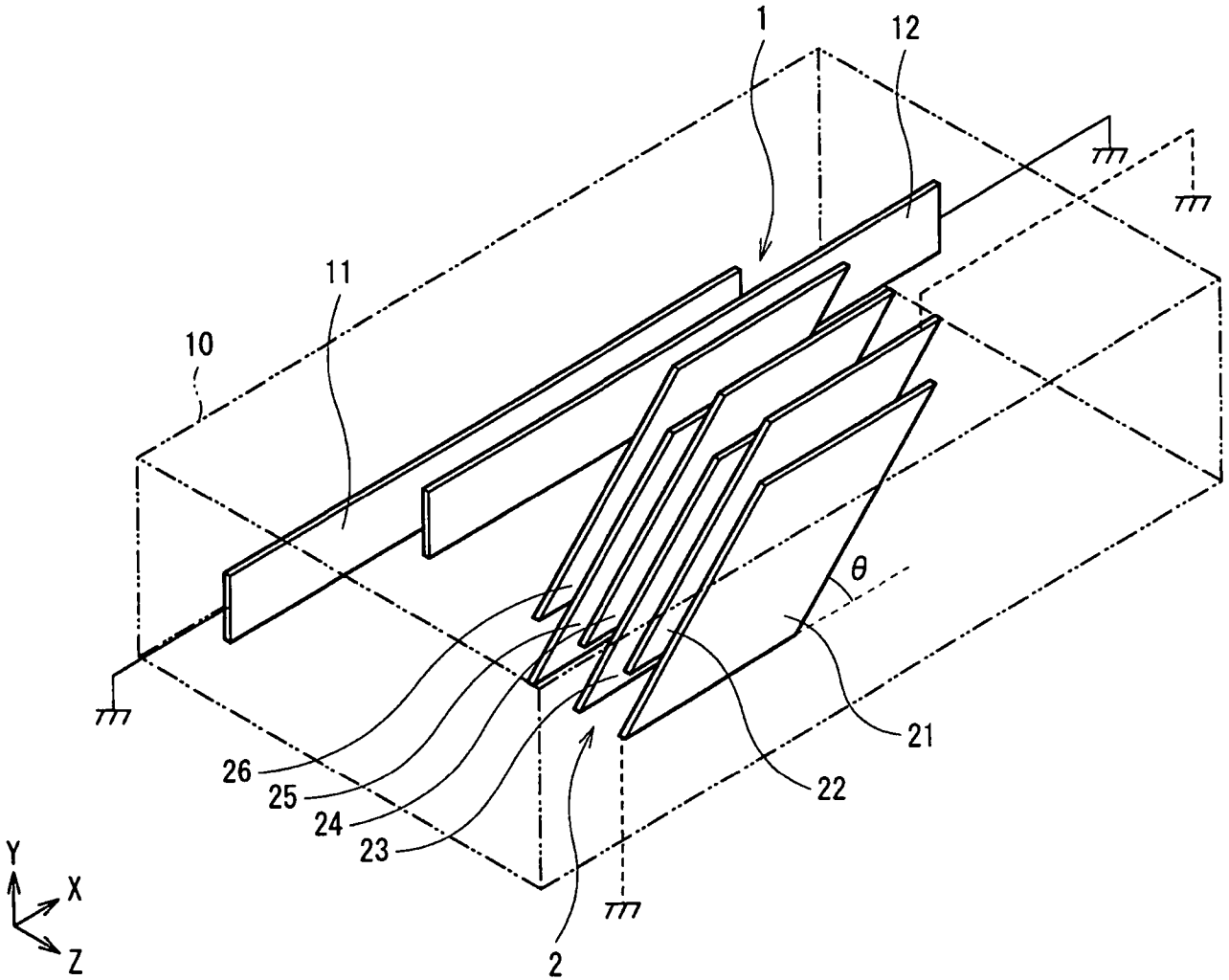
FIG. 1 shows a perspective diagram showing a configuration example of a filter according to a first embodiment of the invention.
Figure 2A:
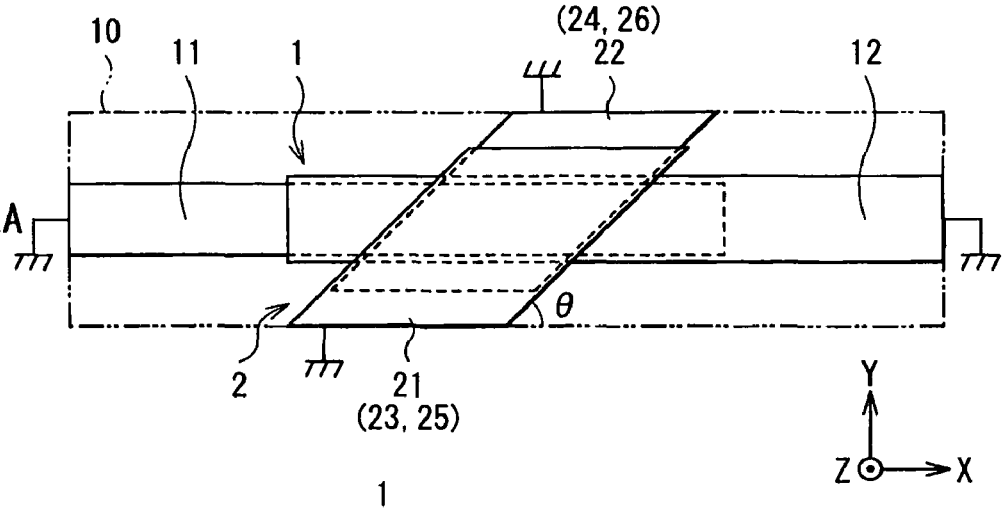
FIGS. 2A and 2B show side diagrams showing the configuration example of the filter according to the first embodiment of the invention.
Figure 2B:
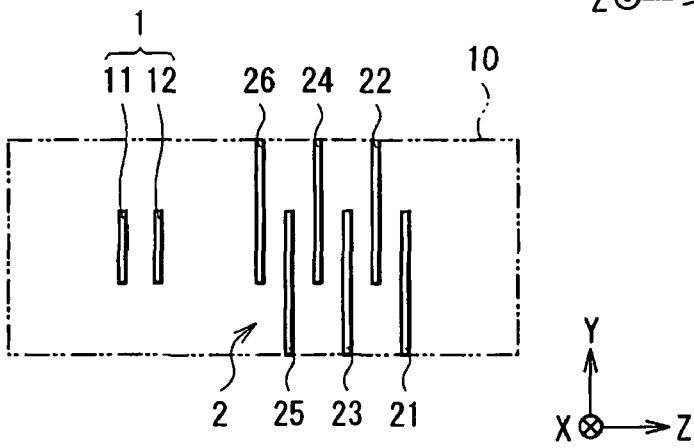

FIG. 1 shows a configuration example of a filter according to the embodiment. FIG. 2(A) shows the filter of FIG. 1 while being seen from a side face in a Z direction of FIG. 1. FIG. 2(B) shows the filter of FIG. 1 while being seen from a side face in an X direction of FIG. 1. The filter according to the embodiment has a first resonator 1 having quarter-wavelength resonators 11 and 12 facing each other, and a second resonator 2 having different quarter-wavelength resonators 21, 22, 23, 24, 25 and 26 facing one another. As shown in FIG. 1, the filter has a dielectric block 10 including a dielectric material and generally having an approximately rectangular shape, where the dielectric block is formed to have a multilayer structure. A line pattern (strip line) of a conductor configuring a TEM line is formed within the dielectric block, and the inside line pattern is used to form the quarter-wavelength resonators 11 and 12 and the different quarter-wavelength resonators 21, 22, 23, 24, 25 and 26 as inner layers. For example, such a structure can be achieved by preparing a plurality of sheet-like dielectric substrates, then forming each line portion by a line pattern of a conductor on each of the sheet-like dielectric substrates, and then superposing the sheet-like dielectric substrates on one another so as to form a stacked structure. Ground electrodes are formed on "a first surface" and "a second surface" (two side faces in an X direction of FIG. 1) opposed to each other of the dielectric block 10 respectively. Moreover, ground electrodes are formed on "a third surface" and "a fourth surface" (top and bottom, or two side faces in a Y direction of FIG. 1) of the dielectric block 10 respectively, the third and fourth surfaces being perpendicular to the first and second surfaces and opposed to each other.

The quarter-wavelength resonators 11 and 12 configure a pair of quarter-wavelength resonators being interdigital-coupled to each other. In the different quarter-wavelength resonators 21, 22, 23, 24, 25 and 26, respective opposed resonators are interdigital-coupled to each other by turns, thereby a plurality of quarter-wavelength resonator pairs are configured. As previously described using FIGS. 22 to 26, the pair of interdigital-coupled quarter-wavelength resonators has the first resonance mode where resonance occurs at the first resonance frequency $f_1$, and the second resonance mode where resonance occurs at the second resonance frequency $f_2$ lower than the first resonance frequency $f_1$. The quarter-wavelength resonators 11 and 12, and the different quarter-wavelength resonators 21, 22, 23, 24, 25 and 26 are configured such that an operation frequency (passing frequency of a filter) corresponds to the second resonance frequency $f_2$. In addition, the filter is configured such that the first resonator 1 and the second resonator 2 resonate at the relatively low, second resonance frequency $f_2$ respectively, and thus electromagnetically coupled to each other at the second resonance frequency. Thus, a bandpass filter using the second resonance frequency $f_2$ as the passing frequency is configured.

The quarter-wavelength resonators 11 and 12 configuring the first resonator 1 are formed by a linear conductor line pattern extending in a horizontal direction (X direction of FIG. 1). In the first quarter-wavelength resonator 11 configuring the first resonator 1, one end is formed to be an open end, and the other end is connected to the ground electrode on one side face (the first surface) of the dielectric block 10 and thus formed to be a short-circuit end. In the second quarter-wavelength resonator 12, one end is formed to be an open end, and the other end is connected to the ground electrode on the other side face (the second surface) of the dielectric block 10 and thus formed to be a short-circuit end.

On the other hand, the different quarter-wavelength resonators 21, 22, 23, 24, 25 and 26 configuring the second resonator 2 are formed by a linear conductor line pattern extending obliquely in a vertical direction (Y direction of FIG. 1). In each of the second, fourth and sixth quarter-wavelength resonators 22, 24 and 26 of the second resonator 2, one end is formed to be an open end, and the other end is connected to the ground electrode on the top (the third surface) of the dielectric block 10 and thus formed to be a short-circuit end. Moreover, in each of the first, third and fifth quarter-wavelength resonators 21, 23 and 25, one end is formed to be an open end, and the other end is connected to a ground electrode on the bottom (the fourth surface) of the dielectric block 10 and thus formed to be a short-circuit end.

In this way, within the dielectric block 10, the quarter-wavelength resonators 11 and 12 configuring the first resonator 1, and the different quarter-wavelength resonators 21, 22, 23, 24, 25 and 26 configuring the second resonator 2 are formed so as to extend in different directions from each other. Thus, as shown in FIG. 2(A), the first resonator 1 and the second resonator 2 are disposed so as to generally intersect with each other at a predetermined angle θ, and thus electromagnetically coupled to each other. The short-circuit ends of the quarter-wavelength resonators 11 and 12 configuring the first resonator 1 and the short-circuit ends of the different quarter-wavelength resonators 21, 22, 23, 24, 25 and 26 configuring the second resonator 2 are connected to separate ground electrodes angled (perpendicular) to each other.

Figure 3:
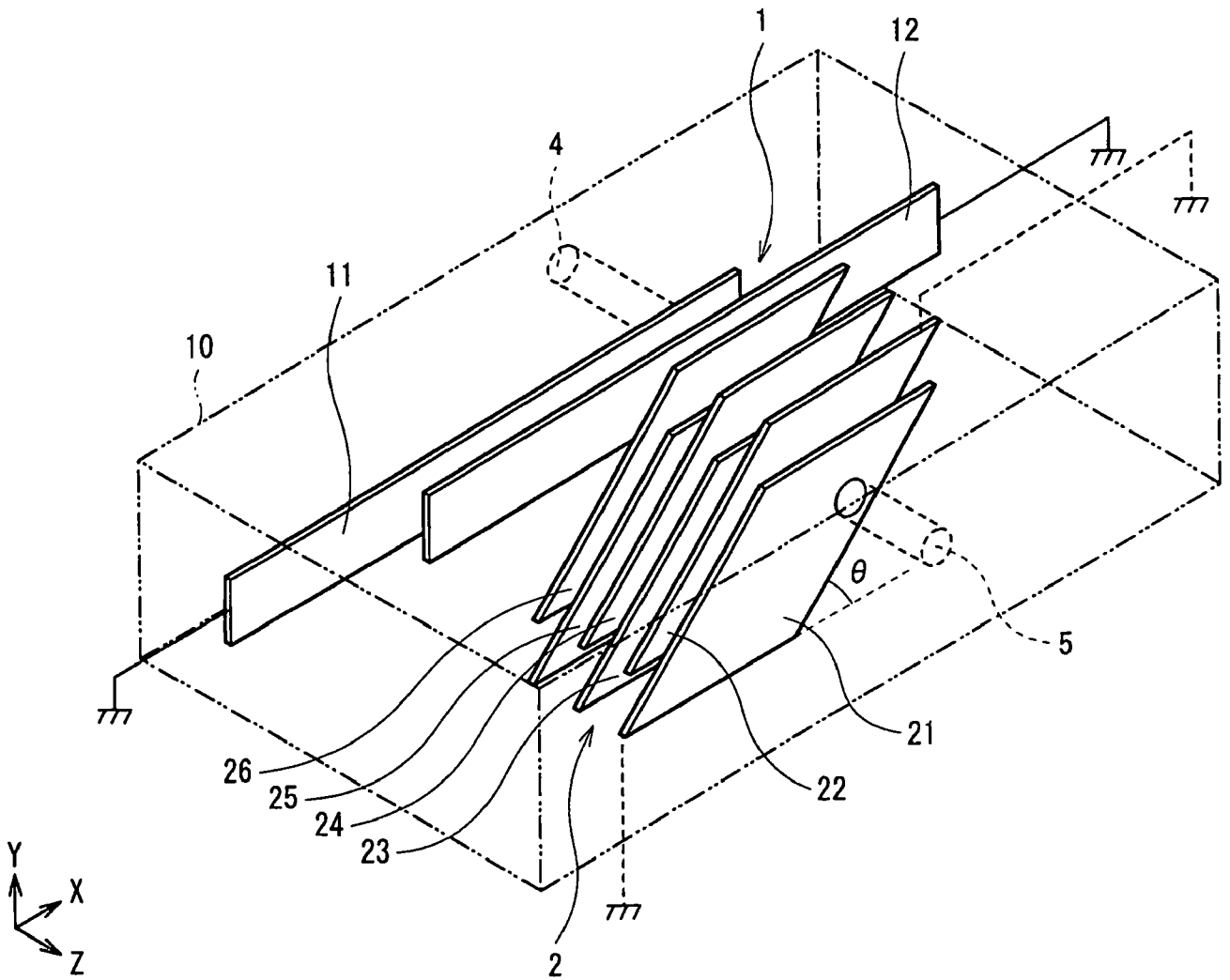
FIG. 3 shows a perspective diagram showing a configuration example where an input terminal and an output terminal are provided in the filter according to the first embodiment of the invention.

In the case of providing input and output terminals in the filter, for example, a configuration as shown in FIG. 3 is considered. In a configuration example of FIG. 3, an input terminal 4 and an output terminal 5 are formed so as to extend to the opposed, fifth and sixth surfaces (two side faces in the Z direction of FIG. 1) of the dielectric block 10. More particularly, the input terminal 4 is formed by a through conductor running through between one end of the first quarter-wavelength resonator 11 of the first resonator 1 and the fifth surface of the dielectric block 10. In addition, the output terminal 5 is formed by a through conductor running through between one end of the first quarter-wavelength resonator 21 of the second resonator 2 and the sixth surface of the dielectric block 10.

The filter is not limitedly configured to have unbalanced input, but may be configured to have balanced input. Moreover, the filter is not limitedly configured to have unbalanced output, but may be configured to have balanced output. In the case of balanced input or balanced output, it is only necessary that at least one set of balanced terminal pair for transmitting a balanced signal are formed in the first resonator 1 or the second resonator 2.

Next, operation of the filter according to the embodiment is described.

In the filter, the first resonator 1 and the second resonator 2 are configured to include the pair of interdigital-coupled quarter-wavelength resonators respectively, and the relatively low, second resonance frequency $f_2$ of the pair of interdigital-coupled quarter-wavelength resonators is used as the passband, thereby small size is achieved according to the principle described using FIGS. 22 to 26.

Figure 21:
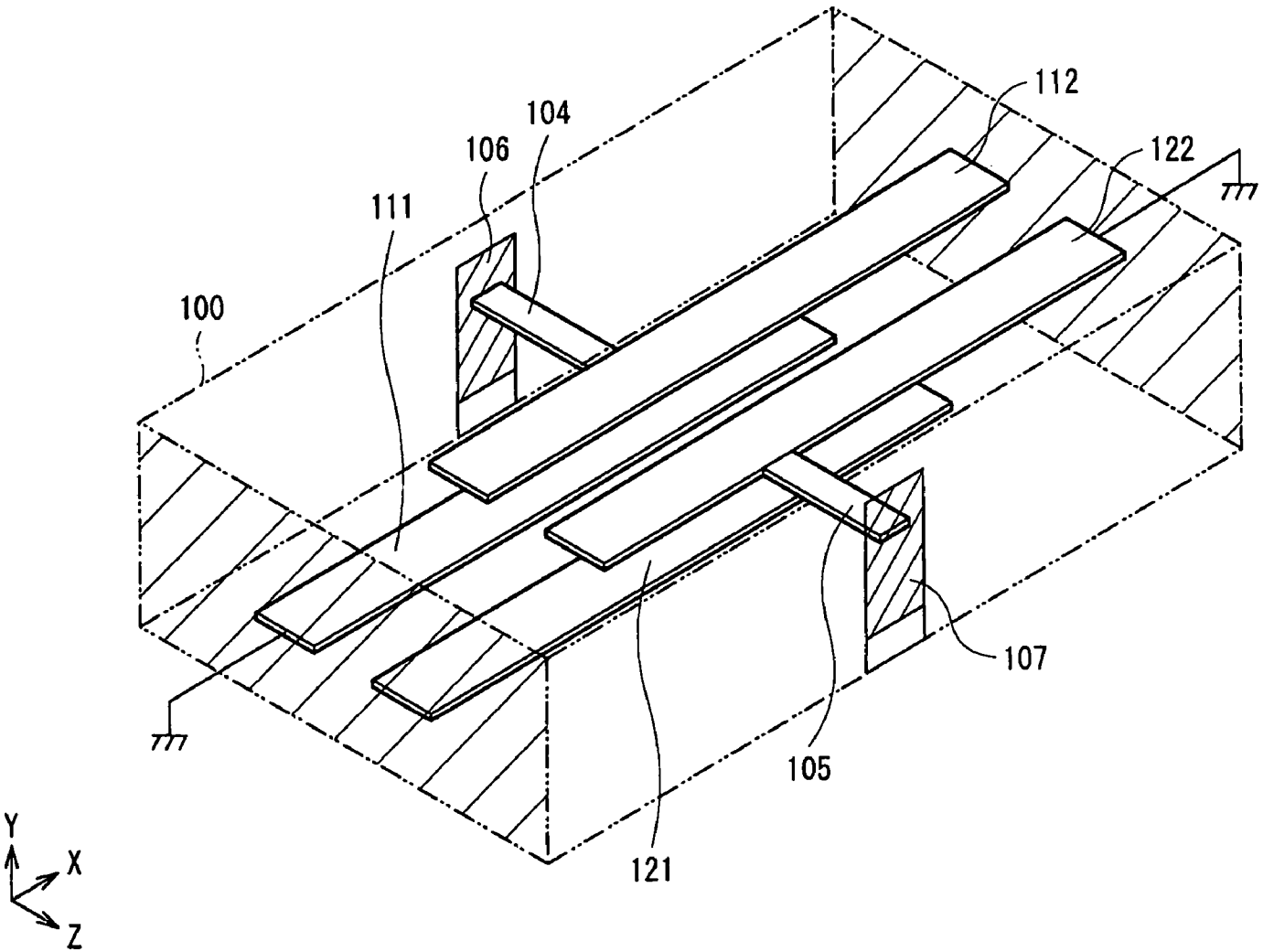
FIG. 21 shows a perspective diagram showing a specific configuration example of the filter using two sets of interdigital-coupled quarter-wavelength resonators pairs.
Figure 22:
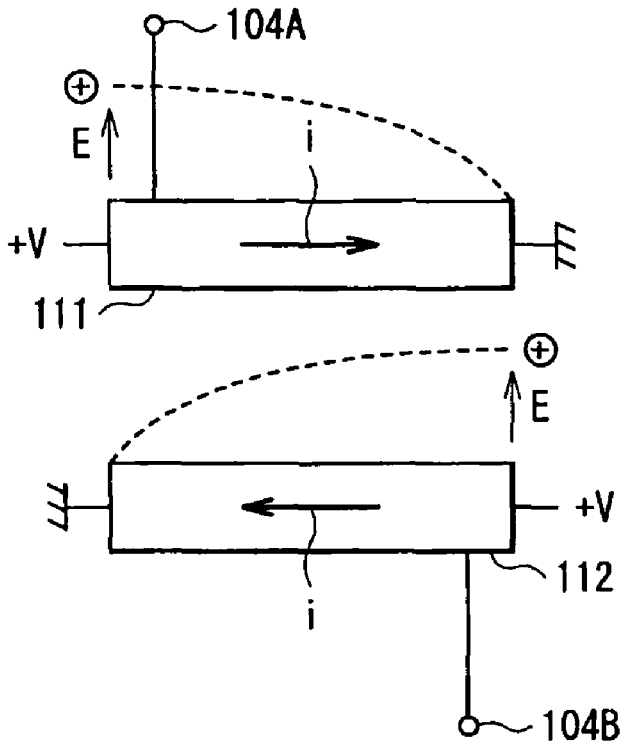
FIG. 22 shows an explanatory diagram showing a first resonance mode of a pair of interdigital-coupled quarter-wavelength resonators.
Figure 23:
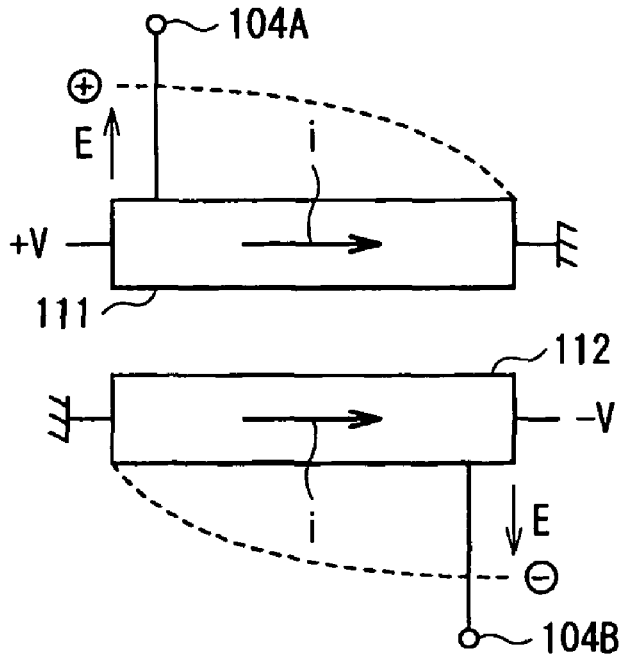
FIG. 23 shows an explanatory diagram showing a second resonance mode of the pair of interdigital-coupled quarter-wavelength resonators.
Figure 24:
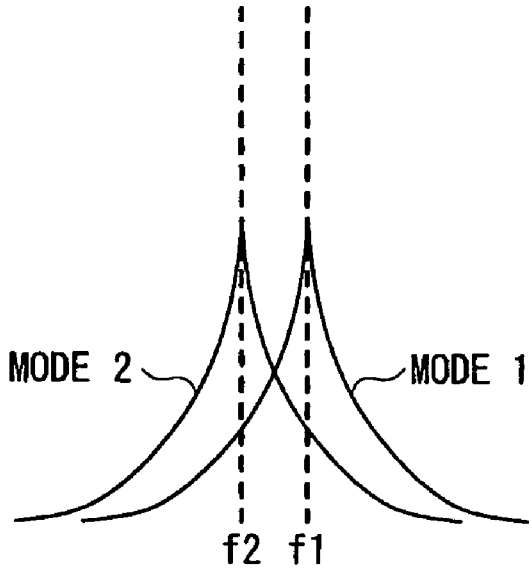
FIG. 24 shows an explanatory diagram showing a resonance mode of two resonators in the case of a low coupling level.
Figure 25:
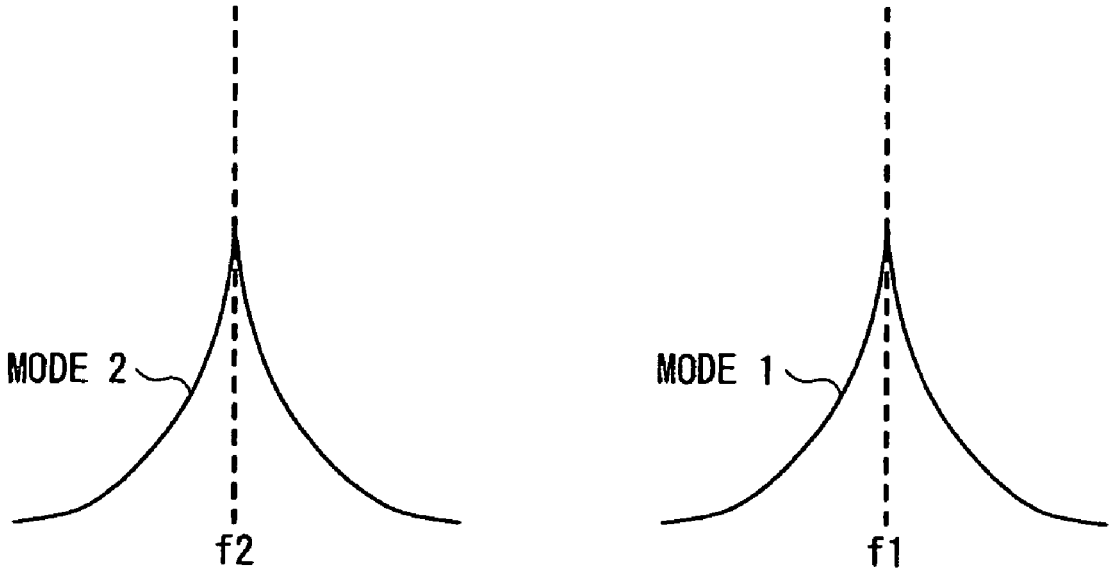
FIG. 25 shows an explanatory diagram showing a resonance mode of two resonators in the case of a high coupling level.
Figure 26:
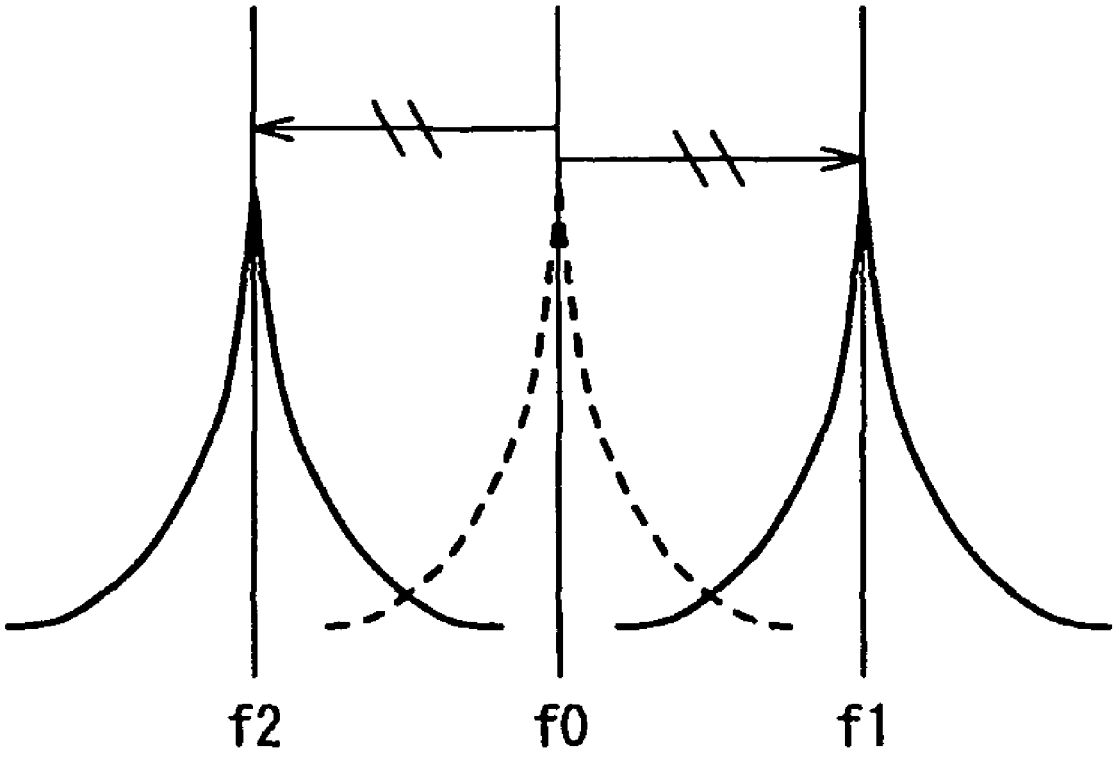
FIG. 26 shows an explanatory diagram showing a distribution condition of resonance frequency in a pair of interdigital-coupled quarter-wavelength resonators.
Figure 27:
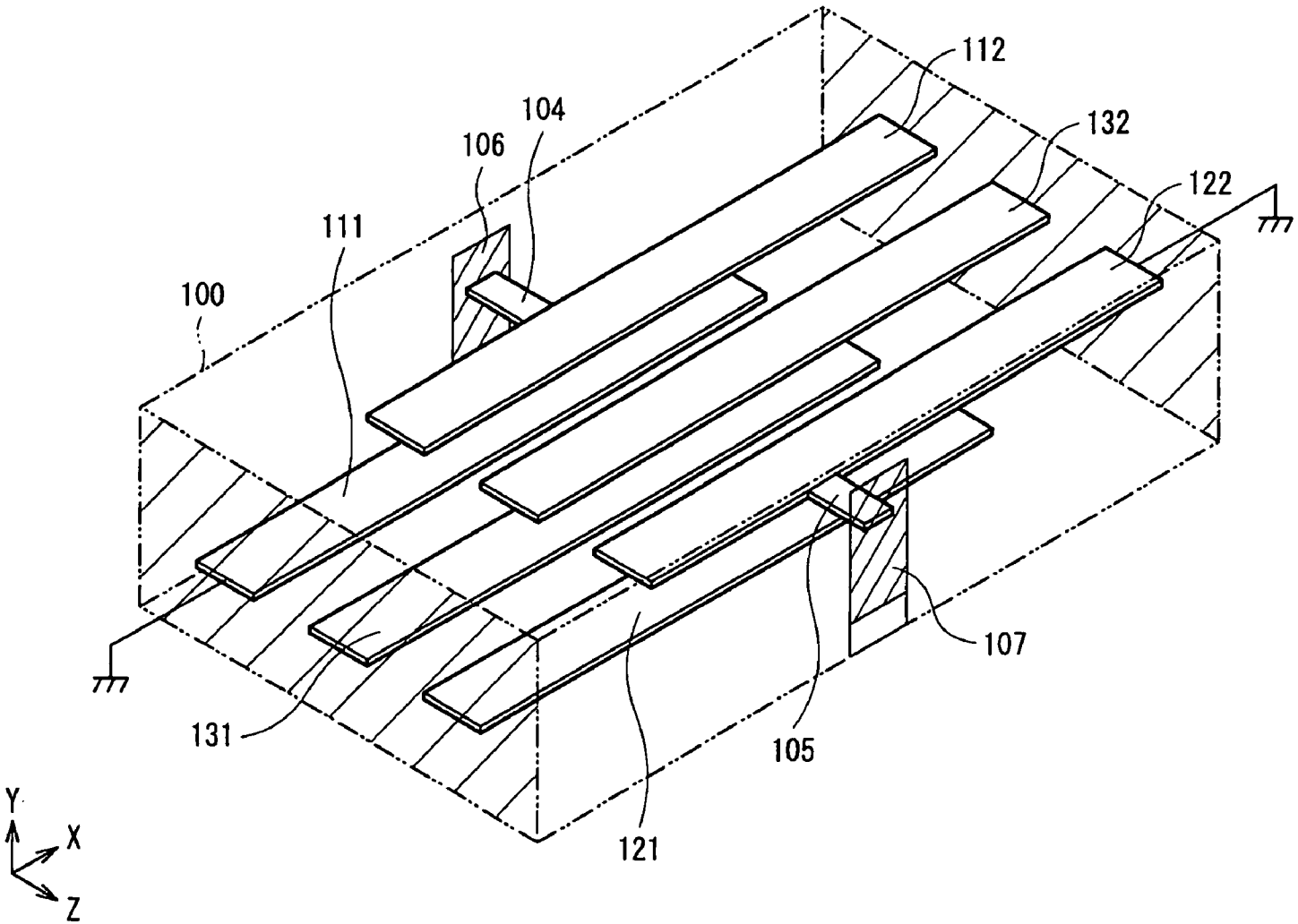
FIG. 27 shows a perspective diagram showing a specific configuration example of a filter using three sets of interdigital-coupled quarter-wavelength resonators pairs.

Moreover, in the filter, the first resonator 1 and the second resonator 2 are disposed so as to generally intersect with each other at a predetermined angle θ, thereby coupling between the resonators is reduced compared with, for example, the case that the first resonator 1 and the second resonator 2 are, as a whole, disposed in parallel to each other as in the configuration example shown in FIG. 21. The angle θ, with which the first resonator 1 and the second resonator 2 are disposed respectively, is adjusted, thereby coupling between the resonators may be made into a desired state. Thus, a desired narrowband filter characteristic is obtained.

Figure 4:
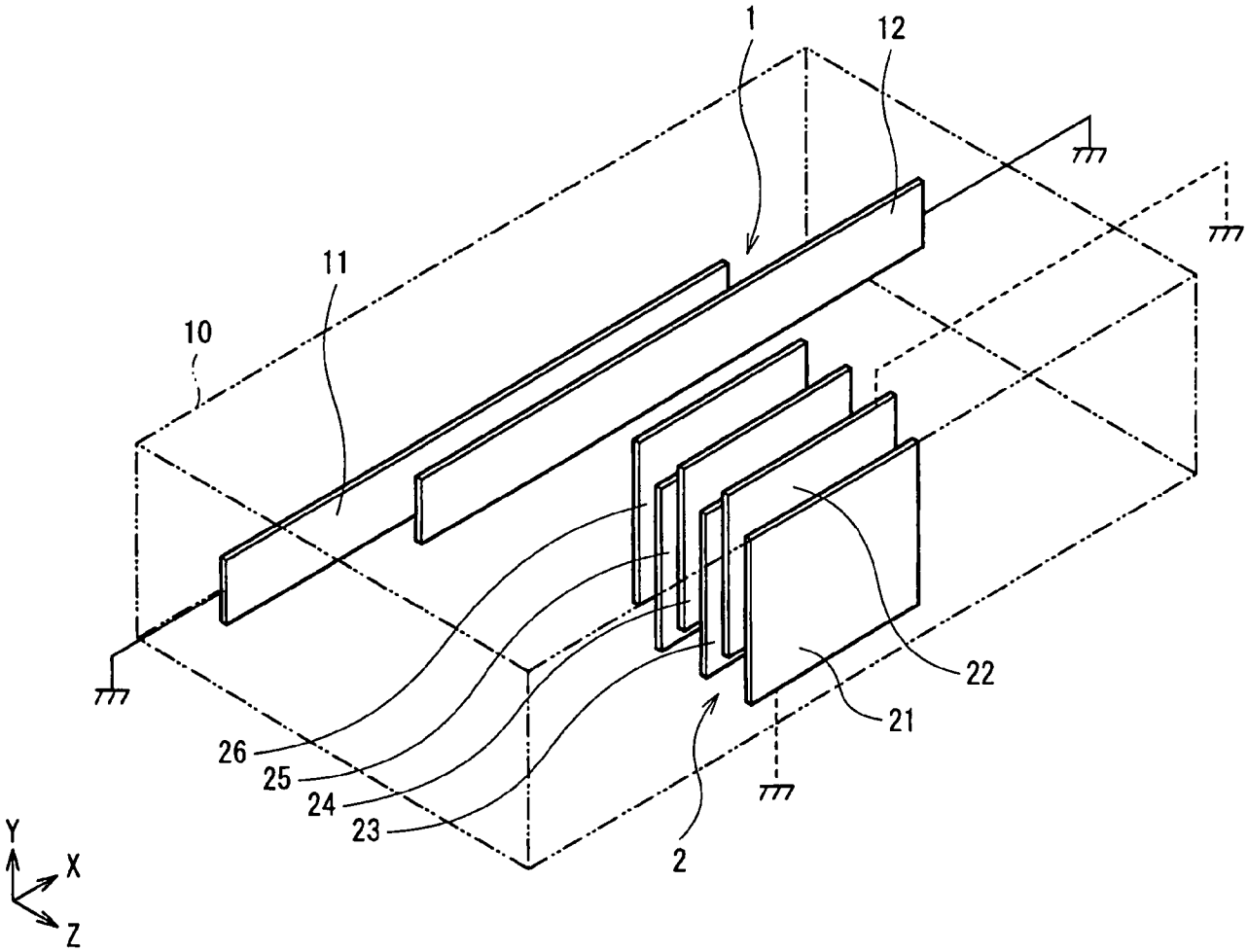
FIG. 4 shows a perspective diagram showing a different configuration example of the filter according to the first embodiment of the invention.
Figure 5:
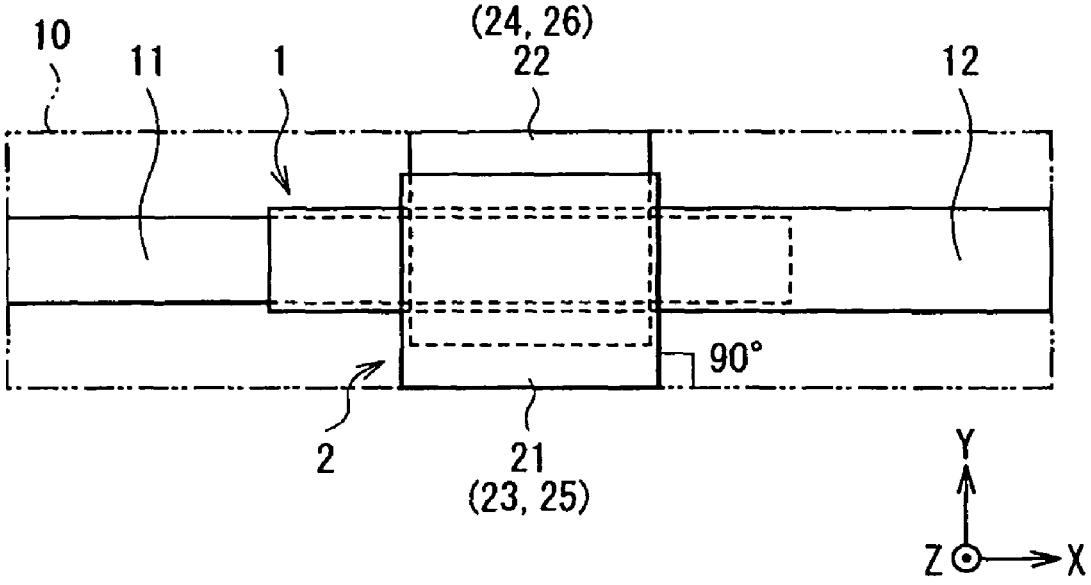
FIG. 5 shows a side diagram showing the different configuration example of the filter according to the first embodiment of the invention.
Figure 19:
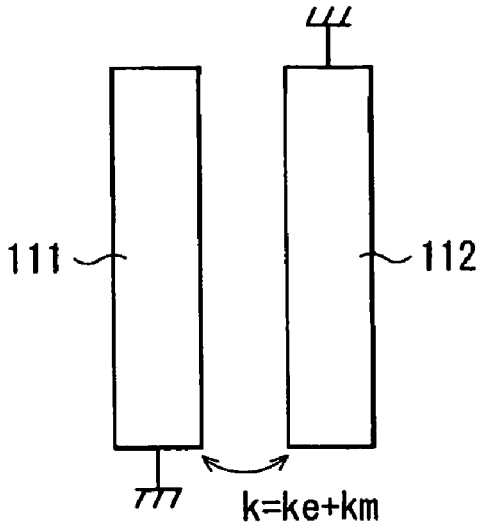
FIG. 19 shows a block diagram showing a basic configuration of a pair of interdigital-coupled quarter-wavelength resonators.
Figure 20:
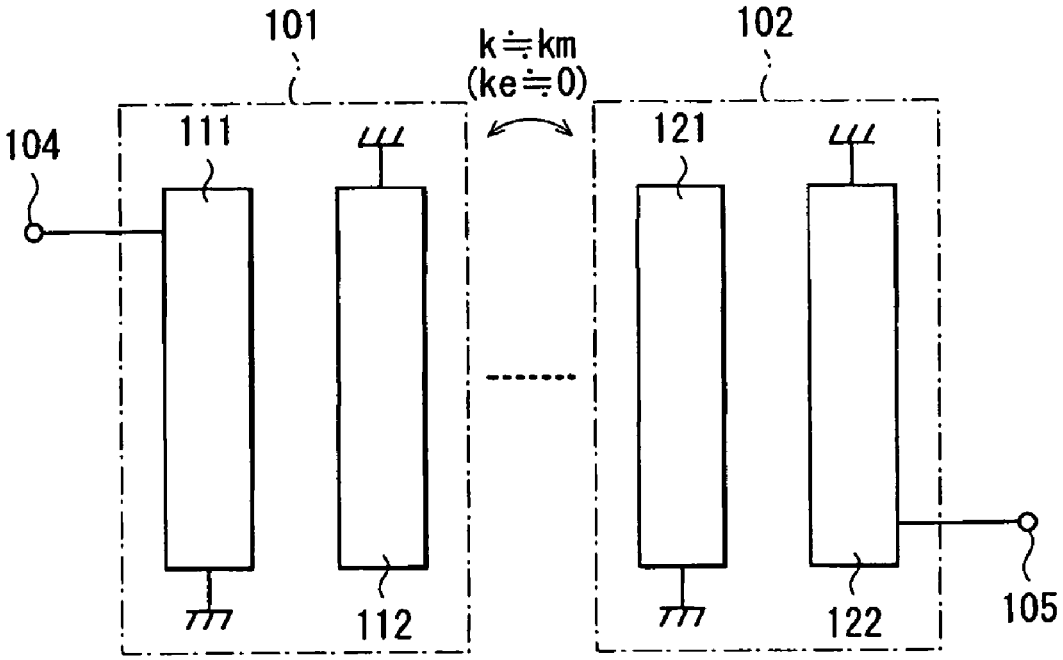
FIG. 20 shows a block diagram showing a basic configuration of a filter using two sets of interdigital-coupled quarter-wavelength resonators pairs.

FIGS. 4 and 5 show a configuration in the case that coupling between the resonators is minimized (the angle θ is 90°) in the filter. FIG. 5 shows the filter of FIG. 4 while being seen from a side face in a Z direction of FIG. 4. In the configuration example, the quarter-wavelength resonators 11 and 12 configuring the first resonator 1 extend in a perfectly horizontal direction (X direction of FIG. 1), and the different quarter-wavelength resonators 21, 22, 23, 24, 25 and 26 configuring the second resonator 2 extend in a perfectly vertical direction (Y direction of FIG. 1), thereby the first resonator 1 and the second resonator 2 are disposed so as to be perpendicular to each other. In such a condition, a magnetic field generated by the first resonator 1 and a magnetic field generated by the second resonator 2 are perpendicular to each other. In the filter, according to the principle described using FIGS. 19 to 21, coupling between the first resonator 1 and the second resonator 2 is hardly caused by an electric field, and dominantly caused by a magnetic field. Therefore, coupling between the first resonator 1 and the second resonator 2 is minimized in the case that magnetic field coupling is minimized. The case that the magnetic field generated by the first resonator 1 and the magnetic field generated by the second resonator 2 are perpendicular to each other corresponds to the case of such minimized coupling.

Conversely, in the case of the angle θ=0°, the magnetic field generated by the first resonator 1 and the magnetic field generated by the second resonator 2 intensify each other, so that coupling between the first resonator 1 and the second resonator 2 is maximized. Consequently, in the filter, coupling having optional intensity is obtained between the angle θ=0° and the angle θ=90°. Actually, simulation was performed assuming that the first resonance frequency $f_1$ was 2.471 GHz, the second resonance frequency $f_2$ was 2.4567 GHz, and the angle θ was 90°. As a result, k=0.0058 was given as the coupling coefficient k between the first resonator 1 and the second resonator 2, showing substantially no coupling between the resonators.

When the angle θ was assumed to be 45° under the same condition, a result of k=0.047 was obtained.

As described hereinbefore, according to the embodiment, since the first resonator 1 and the second resonator 2 are disposed so as to generally intersect with each other at the predetermined angle θ, thereby coupling between the resonators may be reduced compared with, for example, the case that the first resonator 1 and the second resonator 2 are, as a whole, disposed in parallel to each other. Thus, the angle θ, with which the first resonator 1 and the second resonator 2 are disposed respectively, is adjusted, thereby a desired narrowband filter characteristic may be obtained. Moreover, since the first resonator 1 and the second resonator 2 are configured using the interdigital-coupled quarter-wavelength resonators respectively, small size is easily achieved.

[Second Embodiment]

Next, a second embodiment of the invention is described. Substantially the same components as those of the filter according to the first embodiment are marked with the same reference numerals, and description of them is appropriately omitted.

Figure 6:
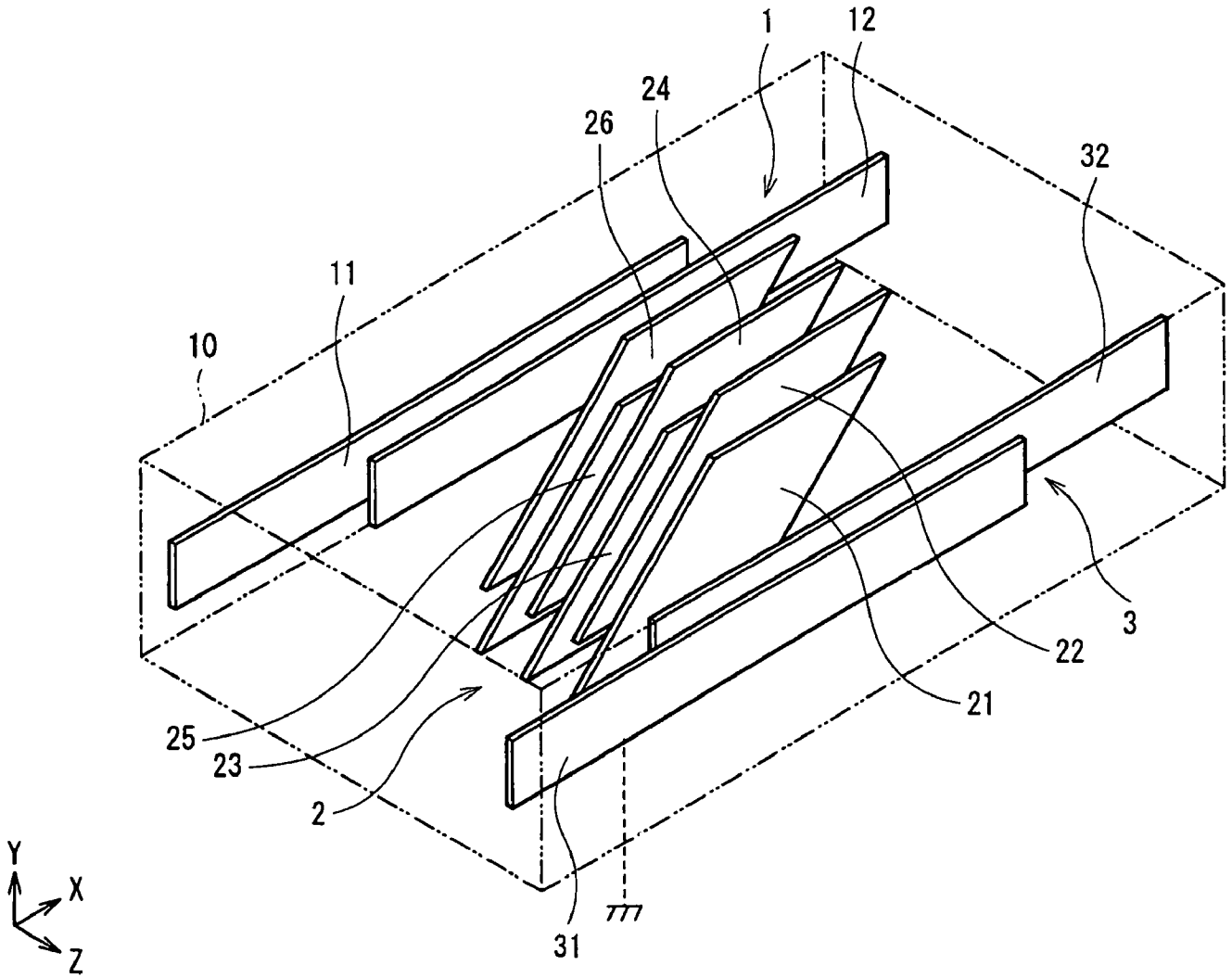
FIG. 6 shows a perspective diagram showing a configuration example of a filter according to a second embodiment of the invention.

FIG. 6 shows a configuration example of a filter according to the second embodiment of the invention. The filter has a third resonator 3 in addition to the configuration of the filter according to the first embodiment (FIG. 1, and FIGS. 2 (A) and 2(B)). The third resonator 3 is configured in an essentially the same way as the first resonator 1, and has quarter-wavelength resonators 31 and 32 being interdigital-coupled to each other. The quarter-wavelength resonators 31 and 32 configuring the third resonator 3 are formed by a linear conductor line pattern extending in a horizontal direction (X direction of FIG. 1). In the first quarter-wavelength resonator 31 of the third resonator 3, one end is formed to be an open end, and the other end is connected to a ground electrode on one side face (the first surface) of the dielectric block 10 and thus formed to be a short-circuit end. In the second quarter-wavelength resonator 32, one end is formed to be an open end, and the other end is connected to a ground electrode on the other side face (the second surface) of the dielectric block 10 and thus formed to be a short-circuit end.

In the filter, the second resonator 2 is disposed between the first resonator 1 and the third resonator 3. Moreover, in the filter, the first resonator 1 and the second resonator 2 are disposed so as to generally intersect with each other at a predetermined angle θ, and the third resonator 3 and the second resonator 2 are disposed so as to generally intersect with each other at a predetermined angle θ, so that the respective resonators are electromagnetically coupled to one another.

Figure 7:
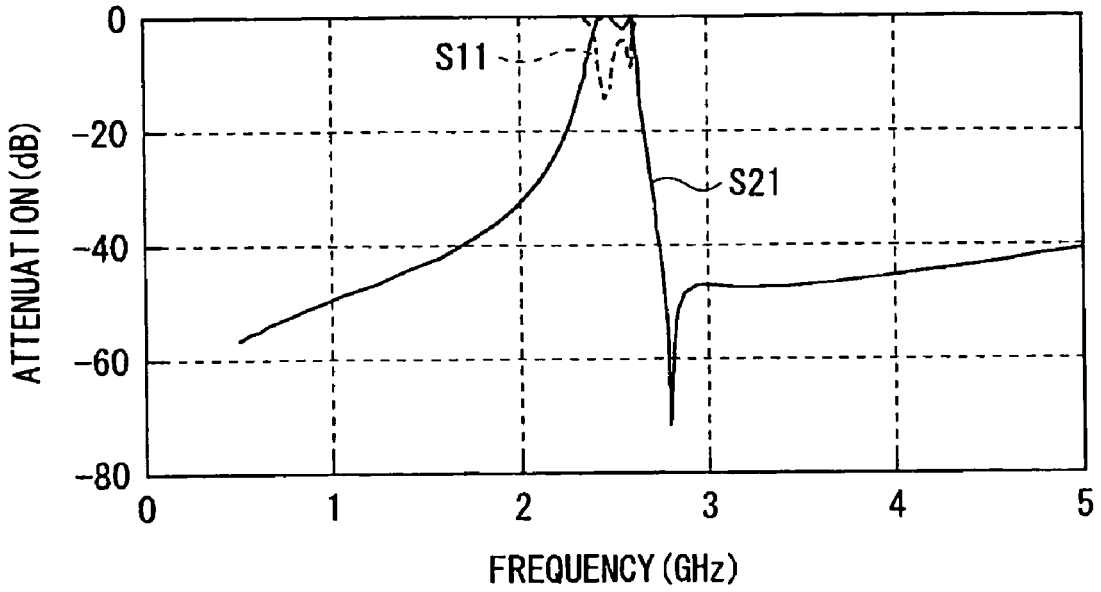
FIG. 7 shows a characteristic diagram showing a transmission characteristic of the filter according to the second embodiment of the invention.
Figure 28:
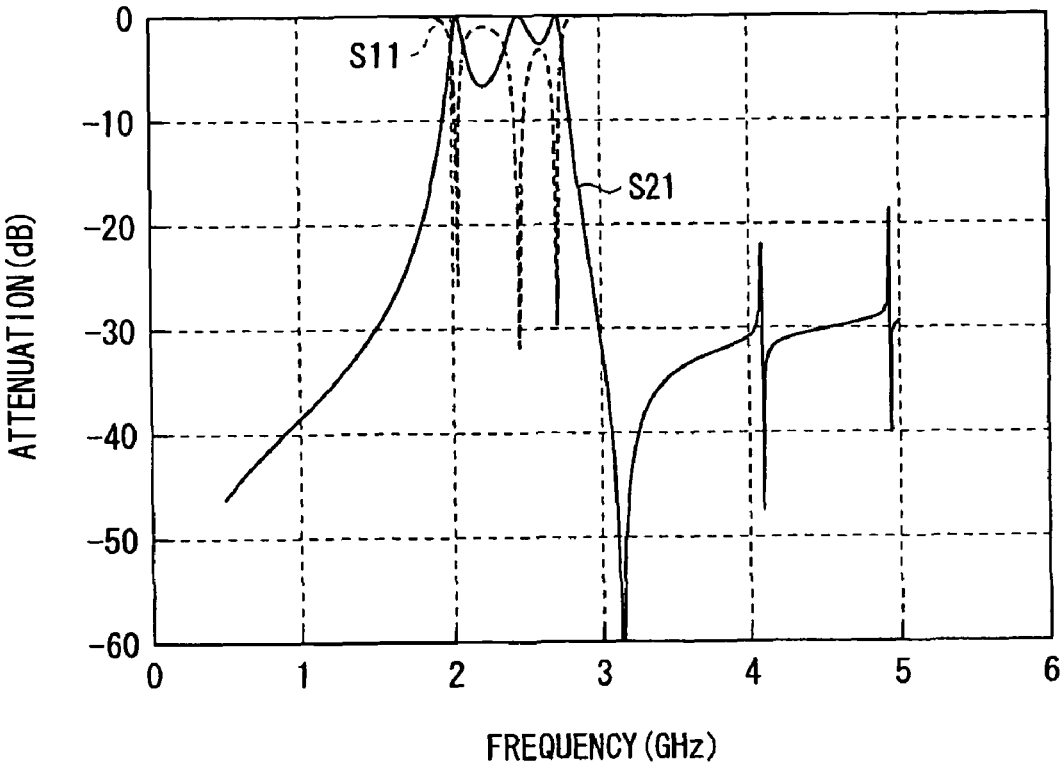
FIG. 28 shows a characteristic diagram showing a transmission characteristic of the filter shown in FIG. 27.

FIG. 7 shows an attenuation characteristic and a loss characteristic of the filter. A horizontal axis shows frequency and a vertical axis shows attenuation. In FIG. 7, a curve with a sign S21 shows a passing loss characteristic of a signal in the filter. A curve with a sign S11 shows a reflection loss characteristic seen from an input side. As known from FIG. 7, a characteristic is obtained, which is narrow in band compared with the characteristic of the configuration where three resonators are, as a whole, disposed in parallel to each other (refer to FIG. 28), and has an attenuation pole at a higher band side.

[Third Embodiment]

Next, a third embodiment of the invention is described. Substantially the same components as those of the filter according to the first or second embodiment are marked with the same reference numerals, and description of them is appropriately omitted.

Figure 8:
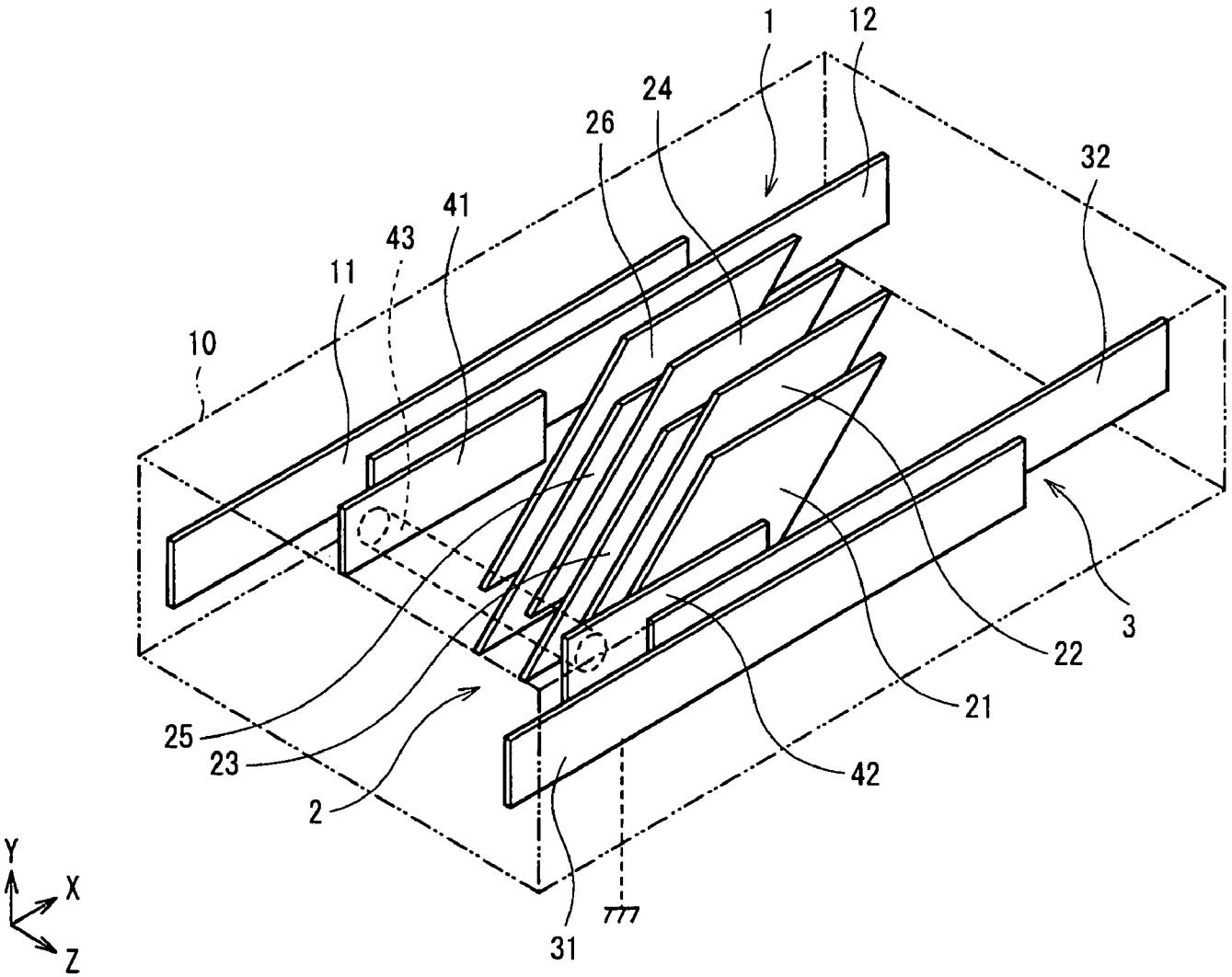
FIG. 8 shows a perspective diagram showing a configuration example of a filter according to a third embodiment of the invention.
Figure 9:
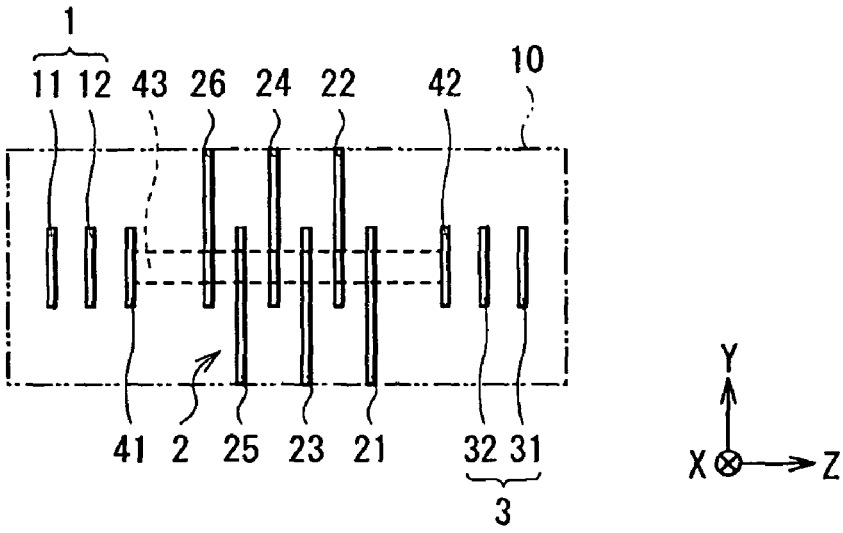
FIG. 9 shows a side diagram showing the configuration example of the filter according to the third embodiment of the invention.

FIGS. 8 and 9 show a configuration example of a filter according to the third embodiment of the invention. FIG. 9 shows the filter of FIG. 8 while being seen from a side face in an x direction of FIG. 8. The filter has capacitive coupling electrodes 41 and 42 in addition to the configuration of the filter according to the second embodiment (FIG. 6). One capacitive coupling electrode 41 is disposed between the first resonator 1 and the second resonator 2. The other capacitive coupling electrode 42 is disposed between the second resonator 2 and the third resonator 3. Ends of the capacitive coupling electrodes 41 and 42 are conducted to each other via a through conductor 43.

Figure 10:
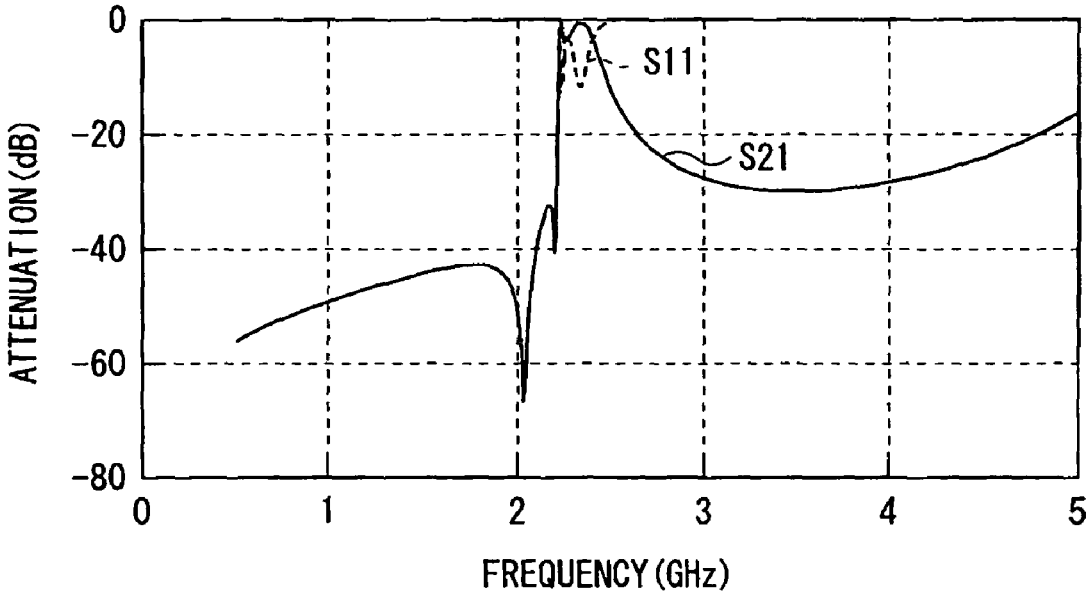
FIG. 10 shows a characteristic diagram showing a transmission characteristic of the filter according to the third embodiment of the invention.

FIG. 10 shows an attenuation characteristic and a loss characteristic of the filter. A horizontal axis shows frequency, and a vertical axis shows attenuation. In FIG. 10, a curve with a sign S21 shows a passing loss characteristic of a signal in the filter. A curve with a sign S11 shows a reflection loss characteristic seen from an input side. As known from FIG. 10, a characteristic is obtained, which is narrow in band compared with the characteristic of the configuration where three resonators are, as a whole, disposed in parallel to each other (refer to FIG. 28), and has an attenuation pole at a lower band side.

[Fourth Embodiment]

Next, a fourth embodiment of the invention is described. Substantially the same components as those of the filters according to the first to third embodiments are marked with the same reference numerals, and description of them is appropriately omitted.

Figure 11:
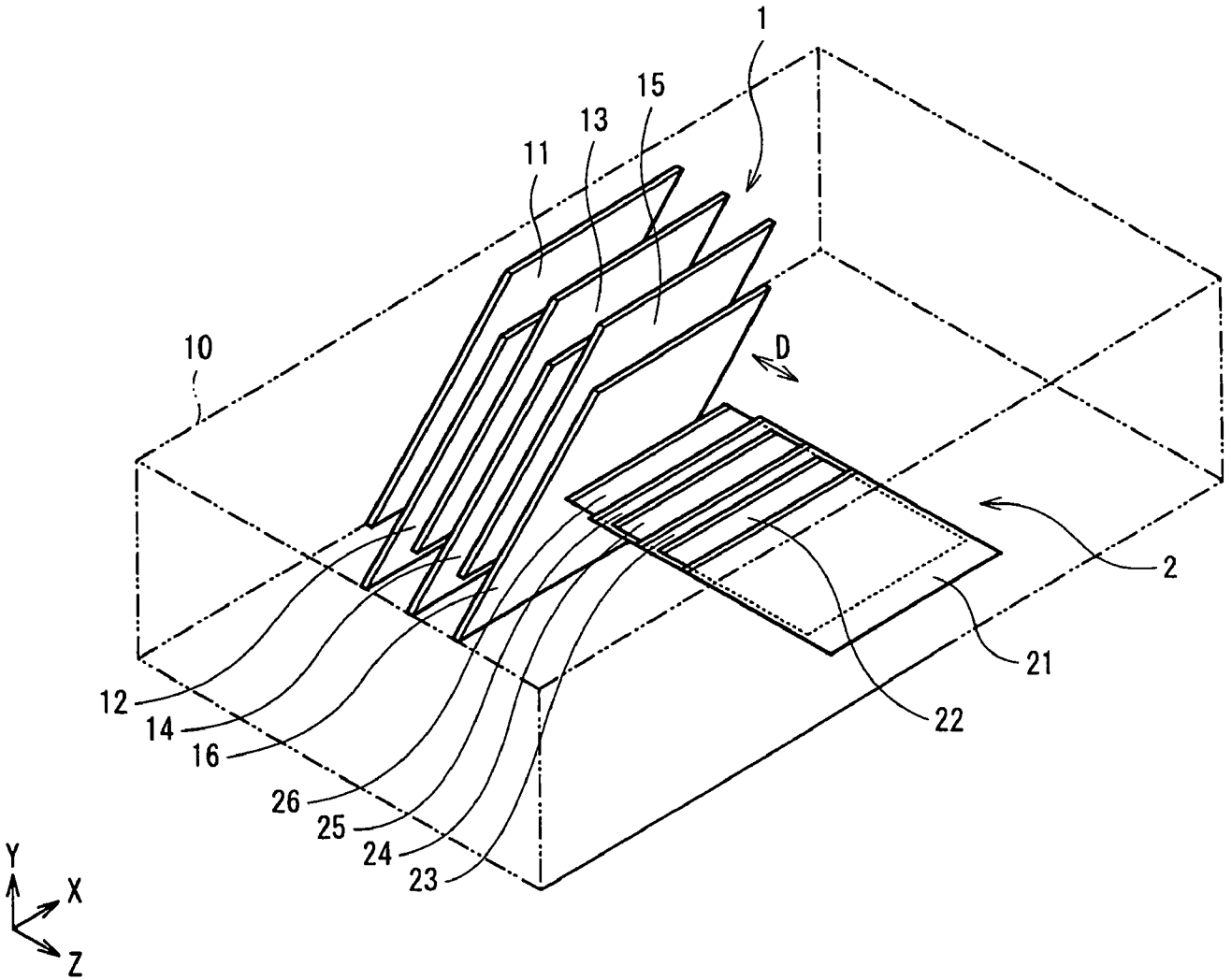
FIG. 11 shows a perspective diagram showing a configuration example of a filter according to a fourth embodiment of the invention.
Figure 12:
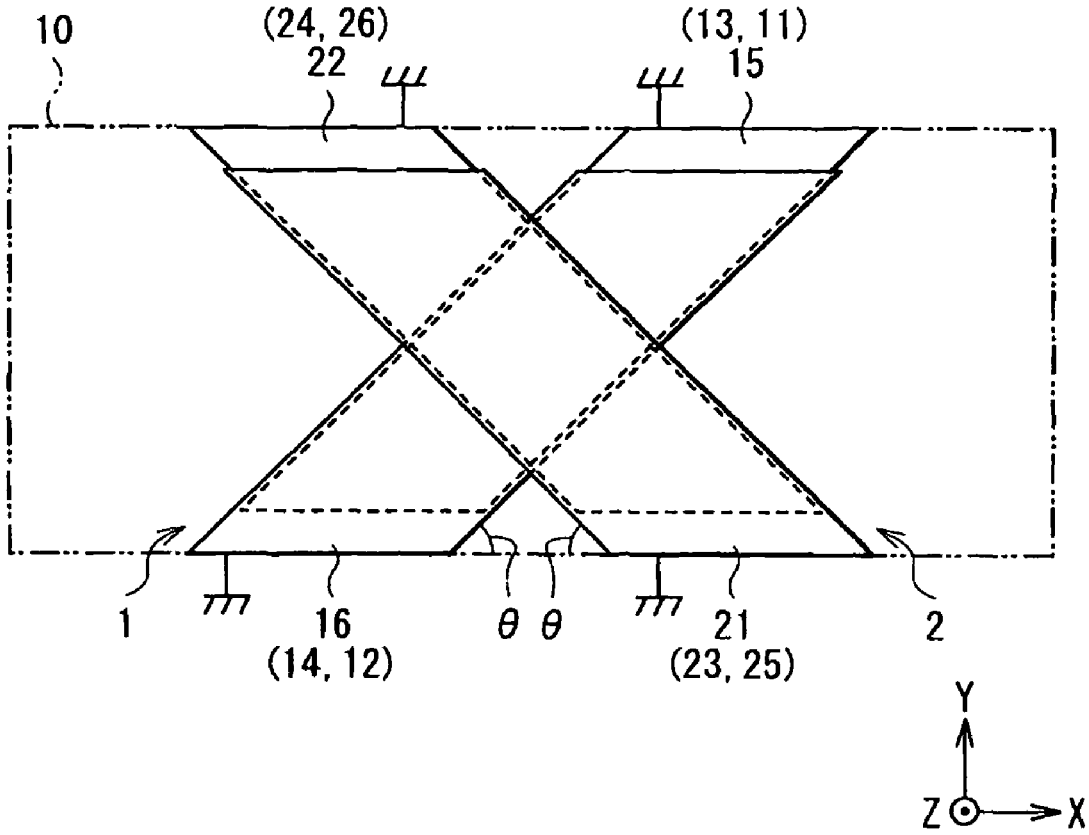
FIG. 12 shows a side diagram showing the configuration example of the filter according to the fourth embodiment of the invention.

FIGS. 11 and 12 show a configuration example of a filter according to the fourth embodiment of the invention. FIG. 12 shows the filter of FIG. 11 while being seen from a side face in a Z direction of FIG. 11. In the filter according to the embodiment, the number of quarter-wavelength resonators configuring the first resonator 1 is made equal to that of the second resonator 2 unlike the filter according to the first embodiment (FIG. 1, and FIGS. 2(A) and 2(B)). That is, the first resonator 1 has first to sixth quarter-wavelength resonators 11, 12, 13, 14, 15 and 16 being disposed oppositely to one another. In the quarter-wavelength resonators, respective opposed quarter-wavelength resonators are interdigital-coupled to each other by turns, thereby a plurality of quarter-wavelength resonator pairs are configured. In the filter according to the first embodiment (FIG. 1, and FIGS. 2(A) and 2(B)), the pair of quarter-wavelength resonators 11 and 12 configuring the first resonator 1 extend in the horizontal direction (X direction of FIG. 1). However, in the filter according to the embodiment, the quarter-wavelength resonators 11, 12, 13, 14, 15 and 16 configuring the first resonator 1 extend obliquely in a vertical direction (Y direction) (but, extend obliquely in a direction opposite to a direction of the second resonator 2) as in the second resonator 2. In each of the first, third and fifth quarter-wavelength resonators 11, 13 and 15 of the first resonator 1, one end is formed to be an open end, and the other end is connected to a ground electrode on the top (the third surface) of the dielectric block 10 and thus formed to be a short-circuit end as in the second, fourth and sixth quarter-wavelength resonators 22, 24 and 26 of the second resonator 2. Moreover, in each of the second, fourth and sixth quarter-wavelength resonators 12, 14 and 16, one end is formed to be an open end, and the other end is connected to a ground electrode on the bottom (the fourth surface) of the dielectric block 10 and thus formed to be a short-circuit end as in the first, third and fifth quarter-wavelength resonators 21, 23 and 25 of the second resonator 2.

In this way, in the filter according to the embodiment, the short-circuit ends of the quarter-wavelength resonators 11, 12, 13, 14, 15 and 16 configuring the first resonator 1, and the short-circuit ends of the different quarter-wavelength resonators 21, 22, 23, 24, 25 and 26 configuring the second resonator 2 are connected to the same corresponding ground electrodes. Moreover, as shown in FIG. 12, the whole first resonator 1 and the whole second resonators 2 are obliquely disposed with an angle θ in opposite directions to each other so that the resonators generally intersect with each other.

FIG. 13 shows a calculation result of values of the coupling coefficient k with the angle θ being variously changed in the filter according to the embodiment. In FIG. 13, a distance D shows an interval between the first resonator 1 and the second resonator 2 (interval in the Z direction of FIG. 11). A symbol f1 shows the first resonance frequency in the first resonance mode, and a symbol f2 shows the second resonance frequency in the second resonance mode. In the filter according to the embodiment, when the angle θ is defined as shown in FIG. 12, a state where the first resonator and the second resonator are perpendicular to each other is given in the case of the angle θ=45°. In the filter according to the first embodiment, a state where the first resonator and the second resonator are perpendicular to each other (state of FIGS. 4 and 5) corresponds to a state where coupling between the resonators is minimized. However, this does not apply in the filter according to the embodiment. This is because since the first resonator 1 and the second resonator 2 are connected to the same corresponding ground electrodes, magnetic fields are formed along the relevant ground electrode in a region near each of the ground electrodes, as a result, magnetic fields do not intersect with each other, leading to coupling. However, even in the filter according to the embodiment, since intensity of coupling is changed by adjusting the angle with which the first resonator 1 and the second resonator 2 are disposed respectively, a desired narrowband filter characteristic may be obtained.

[Fifth Embodiment]

Next, a fifth embodiment of the invention is described. Substantially the same components as those of the filters according to the first to fourth embodiments are marked with the same reference numerals, and description of them is appropriately omitted.

Figure 14:
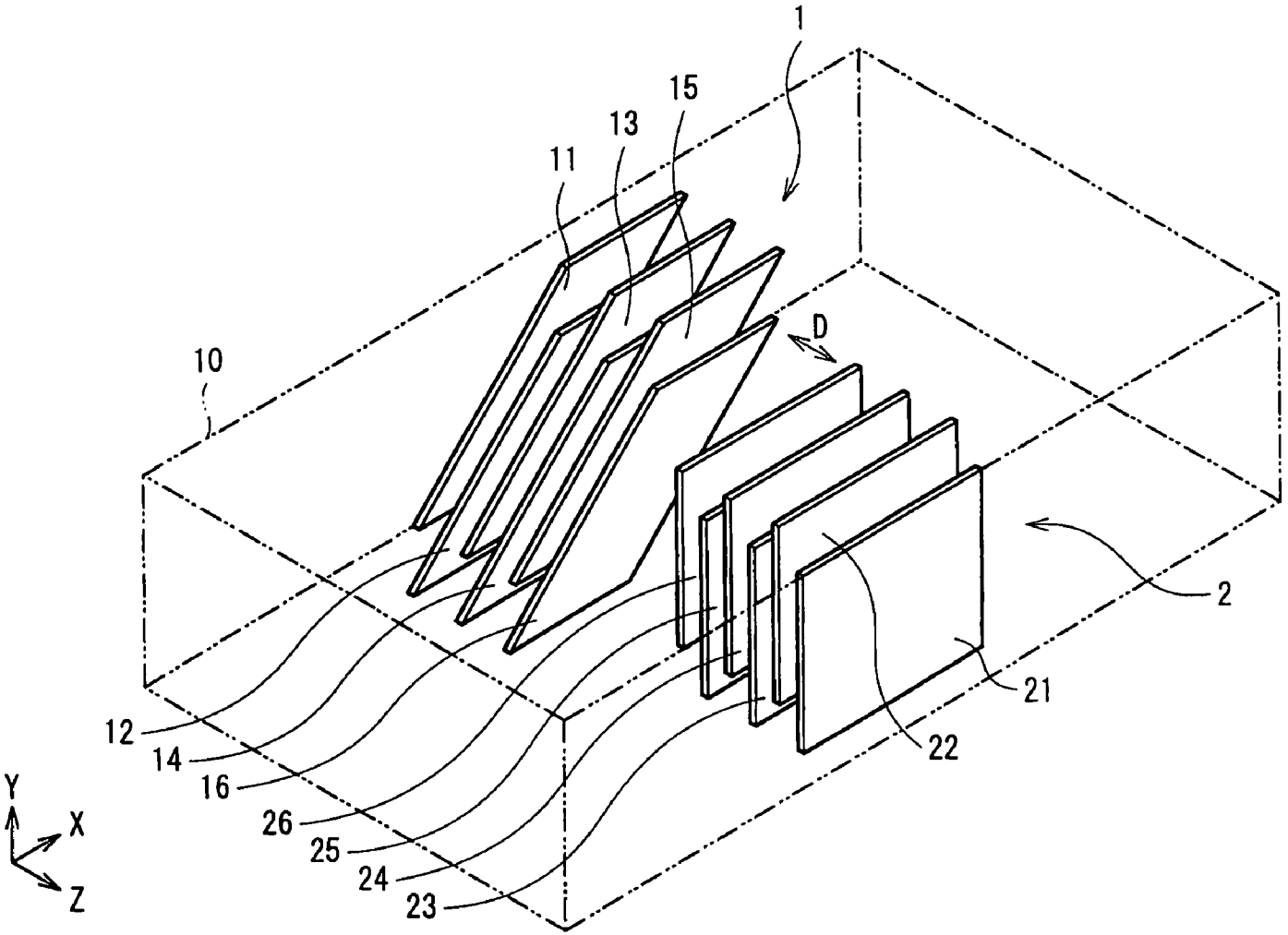
FIG. 14 shows a perspective diagram showing a configuration example of a filter according to a fifth embodiment of the invention.
Figure 15:
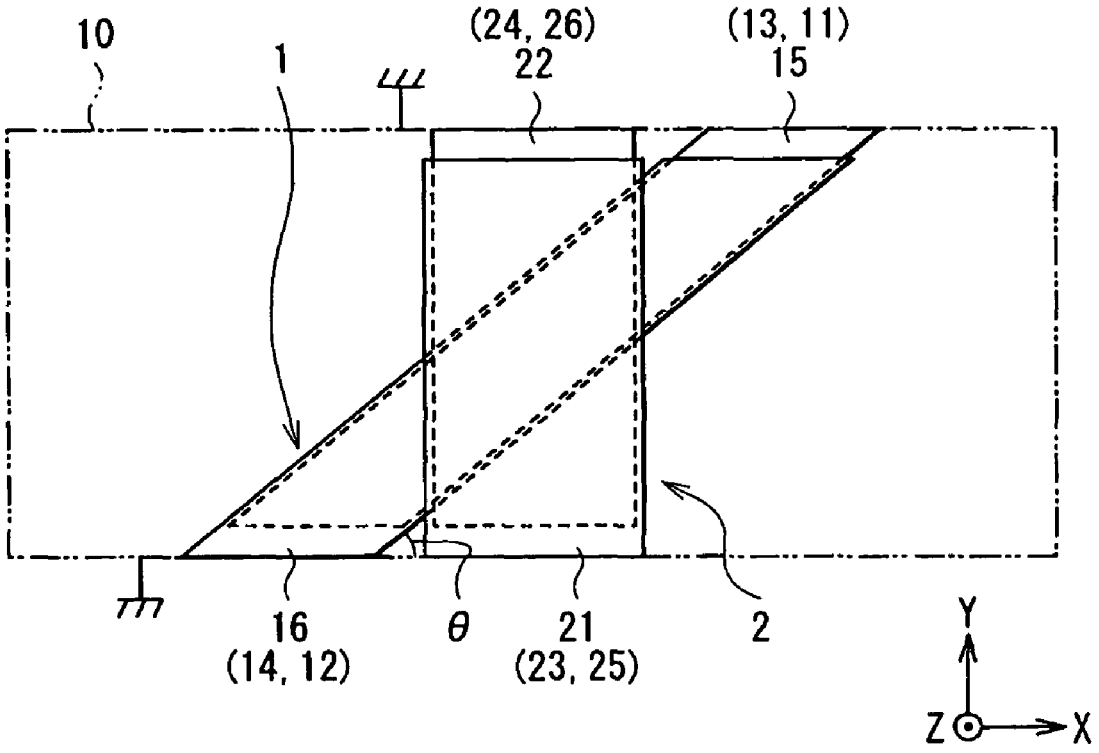
FIG. 15 shows a side diagram showing the configuration example of the filter according to the fifth embodiment of the invention.

FIGS. 14 and 15 show a configuration example of a filter according to the fifth embodiment of the invention. FIG. 15 shows the filter of FIG. 14 while being seen from a side face in a Z direction of FIG. 14. In the filter according to the embodiment, the different quarter-wavelength resonators 21, 22, 23, 24, 25 and 26 configuring the second resonator 2 extend in a perfectly vertical direction (Y direction of FIG. 14), and only the first resonator 1 is obliquely disposed with an angle θ in the vertical direction unlike the filter according to the fourth embodiment (FIGS. 11 and 12).

FIG. 16 shows a calculation result of values of the coupling coefficient k with the angle θ being variously changed in the filter according to the embodiment. In FIG. 16, a distance D shows an interval between the first resonator 1 and the second resonator 2 (interval in the Z direction of FIG. 14). A symbol f1 shows the first resonance frequency in the first resonance mode, and a symbol f2 shows the second resonance frequency in the second resonance mode. Even in the filter according to the embodiment, since intensity of coupling is changed by adjusting the angle with which the first resonator 1 is disposed, a desired narrowband filter characteristic may be obtained.

[Sixth Embodiment]

Next, a sixth embodiment of the invention is described. Substantially the same components as those of the filters according to the first to fifth embodiments are marked with the same reference numerals, and description of them is appropriately omitted.

Figure 17:
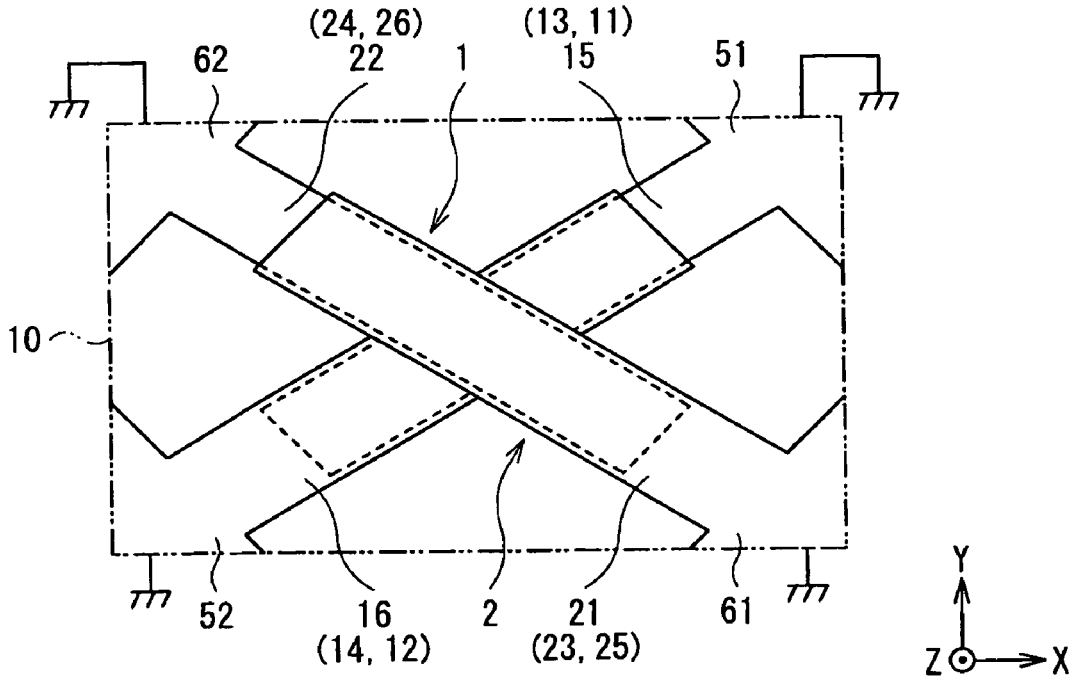
FIG. 17 shows a side diagram showing a configuration example of a filter according to a sixth embodiment of the invention.
Figure 18:
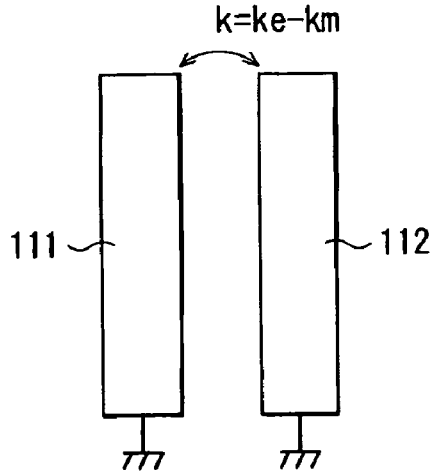
FIG. 18 shows a block diagram showing a basic configuration of a pair of comb-line-coupled quarter-wavelength resonators.

FIG. 17 shows a configuration example of a filter according to the sixth embodiment of the invention. In the filter according to the embodiment, auxiliary ground electrodes 51 and 52 are provided at short-circuit ends of the first resonator 1, and different, auxiliary ground electrodes 61 and 62 are provided at short-circuit ends of the second resonator 2, in addition to the configuration of the filter according to the fourth embodiment (FIGS. 11 and 12). At a top side, the auxiliary ground electrode 51 extends along a direction which intersects with the extending direction of the first resonator 1, and the different auxiliary ground electrode 62 extends along a direction which intersects with the extending direction of the second resonator 2, resulting in that the auxiliary ground electrode 51 and the different auxiliary ground electrode 62 extend so as to intersect with each other. At a bottom side, the auxiliary ground electrode 52 and the different auxiliary ground electrode 61 have the same configuration as the auxiliary ground electrode 51 and the different auxiliary ground electrode 62 at the top side. In the filter according to the fourth embodiment, since the short-circuit ends of the first resonator 1 and the short-circuit ends of the second resonator 2 are connected to the same corresponding ground electrodes, magnetic fields are formed along the relevant ground electrode in a region near each of the ground electrodes, as a result, magnetic fields do not intersect with each other, leading to coupling. In the filter according to the embodiment, the short-circuit ends of the first resonator 1 and the short-circuit ends of the second resonator 2 are connected to the same corresponding ground electrodes via the auxiliary ground electrodes 51 and 52 and the different auxiliary ground electrodes 61 and 62 being disposed with different angles from the electrodes 52 and 51 respectively. Thus, even if the respective short-circuit ends of the first and second resonators are connected to the same corresponding ground electrodes, magnetic fields intersect with each other even in a region near the ground electrode due to the auxiliary ground electrodes 51 and 52 and the different auxiliary ground electrodes 61 and 62, and consequently coupling can be reduced.

[Other Embodiment]

The invention is not limited to the above embodiments, and may be carried out in a variously altered or modified manner. For example, in the embodiments, the number of the quarter-wavelength resonators configuring each of the first resonator 1 and the second resonator 2 is not limited to the number as shown in the figures. Each resonator only has to have at least one set of quarter-wavelength resonator pair.

Moreover, in the fourth to sixth embodiments, the short-circuit ends of the first resonator 1 and the short-circuit ends of the second resonator 2 may be connected to separate ground electrodes disposed in a parallel and stacked manner by using a through conductor or the like, rather than the same corresponding ground electrodes. For example, it may be configured that two ground electrode layers are provided at a top side, and the other ends of the first, third and fifth quarter-wavelength resonators 11, 13 and 15 of the first resonator 1 are connected to one ground electrode layer at the top side, and the other ends of the second, fourth and sixth quarter-wavelength resonators 22, 24 and 26 of the second resonator 2 are connected to the other ground electrode layer at the top side. The same is true for a configuration at a bottom side.

It should be understood by those skilled in the art that various modifications, combinations, sub-combinations and alterations may occur depending on design requirements and other factors insofar as they are within the scope of the appended claims or the equivalent thereof.

What is claimed is:

1. A filter comprising:

a first resonator having a plurality of quarter-wavelength resonators facing each other, each couple of neighboring quarter-wavelength resonators of the plurality of quarter-wavelength resonators being interdigital-coupled to each other, and a second resonator having a plurality of different quarter-wavelength resonators facing each other, each couple of neighboring quarter-wavelength resonators of the plurality of different quarter-wavelength resonators being interdigital-coupled to each other, wherein the first resonator and the second resonator are, as a whole, disposed so as to extend along directions intersecting with each other at a predetermined angle, and are electromagnetically coupled to each other.

2. The filter according to claim 1, wherein a short-circuit end of a quarter-wavelength resonator of the quarter-wavelength resonators configuring the first resonator and a short-circuit end of a different quarter-wavelength resonator of the different quarter-wavelength resonators configuring the second resonator are connected to first and third ground electrodes, respectively, that are angled towards one another.

3. The filter according to claim 2, wherein the first resonator and the second resonator are formed within a dielectric block having a rectangular solid shape, and the first ground electrode and a second ground electrode are formed on first and second surfaces of the dielectric block that face each other, and the third ground electrode and a fourth ground electrode are formed on third and fourth surfaces of the dielectric block that face each other, the third and fourth surfaces being perpendicular to the first and second surfaces, the short-circuit ends of the quarter-wavelength resonators configuring the first resonator are connected to the first and second ground electrodes formed on the first and second surfaces of the dielectric block, respectively and the short-circuit ends of the different quarter-wavelength resonators configuring the second resonator are connected to the third and fourth ground electrodes formed on the third and fourth surfaces of the dielectric block, respectively.

4. The filter according to claim 1, wherein a short-circuit end of a quarter-wavelength resonator of the quarter-wavelength resonators configuring the first resonator and a short-circuit end of a different quarter-wavelength resonator of the different quarter-wavelength resonators configuring the second resonator are connected to a common ground electrode, or first and second ground electrodes parallel to each other.

5. The filter according to claim 4, further comprising:

an auxiliary electrode provided on the short-circuit end of the quarter-wavelength resonator configured in the first resonator so as to extend along a direction intersecting with the extending direction of the quarter-wavelength resonator, and a different auxiliary electrode provided on the short-circuit end of the different quarter-wavelength resonator configured in the second resonator so as to extend along a direction intersecting with the extending direction of the different quarter-wavelength resonator, wherein the auxiliary electrode and the different auxiliary electrode extend so as to intersect with each other, and the short-circuit end of the quarter-wavelength resonator and the short-circuit end of the different quarter-wavelength resonator are connected, via the auxiliary electrode and the different auxiliary electrode, respectively, to the common ground electrode or the first and second ground electrodes parallel to each other.

6. The filter according to claim 1, further comprising:

a third resonator having a plurality of still different quarter-wavelength resonators facing each other, each couple of neighboring quarter-wavelength resonators of the plurality of still different quarter-wavelength resonators being interdigital-coupled to each other, wherein the third resonator and the second resonator are disposed so as to extend along directions intersecting with each other at a predetermined angle, and are electromagnetically coupled to each other.

7. The filter according to claim 6, wherein the second resonator is disposed between the first resonator and the third resonator, a capacitive coupling electrode is disposed between the first resonator and the second resonator, and another capacitive coupling electrode is disposed between the second resonator and the third resonator.

* * * * *